United States Patent [19]

Matsumoto et al.

[11] 4,228,359

[45] Oct. 14, 1980

[54] ROTOR-STRESS PREESTIMATING TURBINE CONTROL SYSTEM

[75] Inventors: Hiroshi Matsumoto; Yoshio Sato, both of Hitachi; Shigeyoshi Kawano, Hitachiota; Yoshiyuki Nakano, Hitachi; Fumio Kato, Hitachi; Katsukuni Hisano, Hitachi; Katsuto Kashiwahara, Hitachi; Yasuhiko Otawara, Katsuta; Toshihiko Higashi, Hitachi; Yasuhiro Tennichi, Hitachi; Jube Matsumura, Hitachi; Koichiro Fukushima, Hitachi, all of Japan

[73] Assignee: Hitachi, Ltd., Japan

[21] Appl. No.: 929,130

[22] Filed: Jul. 28, 1978

[30] Foreign Application Priority Data

| | | | |
|---|---|---|---|
| Jul. 29, 1977 | [JP] | Japan | 52-90312 |
| Jul. 29, 1977 | [JP] | Japan | 52-90313 |
| Jul. 29, 1977 | [JP] | Japan | 52-90314 |
| Jul. 29, 1977 | [JP] | Japan | 52-90315 |
| Jul. 29, 1977 | [JP] | Japan | 52-90316 |
| Jul. 29, 1977 | [JP] | Japan | 52-90317 |
| Aug. 8, 1977 | [JP] | Japan | 52-94192 |
| Aug. 8, 1977 | [JP] | Japan | 52-94195 |
| Aug. 8, 1977 | [JP] | Japan | 52-94196 |
| Aug. 8, 1977 | [JP] | Japan | 52-94198 |
| Aug. 8, 1977 | [JP] | Japan | 52-94199 |
| Aug. 10, 1977 | [JP] | Japan | 52-95176 |

[51] Int. Cl.[3] ..... F01D 19/02

[52] U.S. Cl. ..... 290/40 R; 60/646

[58] Field of Search ..... 290/40, 52; 60/646, 60/658

[56] References Cited

U.S. PATENT DOCUMENTS

| | | | |
|---|---|---|---|
| 3,561,216 | 2/1971 | Moore, Jr. | 60/646 X |
| 3,928,972 | 12/1975 | Osborne | 60/646 |
| 4,029,951 | 6/1977 | Berry et al. | 60/646 X |
| 4,039,846 | 8/1977 | Vance | 290/40 R X |
| 4,117,344 | 9/1978 | Boerstler et al. | 290/52 |

*Primary Examiner*—Gene Z. Rubinson
*Assistant Examiner*—W. E. Duncanson, Jr.
*Attorney, Agent, or Firm*—Craig & Antonelli

[57] ABSTRACT

The present stress in the turbine rotor is estimated at each control period, from the steam temperature and pressure at the turbine inlet. In addition, the future turbine inlet steam temperature or pressure is preestimated once every $n_T$ control cycles, for a given speed or load changing rate, making use of data concerning the changing rate of the turbine steam inlet temperature or pressure in relation with the change of the speed or load, which has been obtained by a learning of the past turbine operating condition. This future steam temperature or pressure at the turbine inlet is used as a factor for preestimating the future stress expected to be caused in the turbine rotor. The preestimation of the rotor stress is performed for a plurality of assumed speed or load changing rates. The turbine is controlled at the maximum speed increase-rate or load changing rate which would not cause the future stress preestimated over a given preestimation time to exceed a limit stress. An observation of the present stress is made at each control period to check whether the limit stress is not exceeded by the present stress.

29 Claims, 18 Drawing Figures

ROTOR-STRESS PREESTIMATING TURBINE CONTROL SYSTEM

BACKGROUND OF THE INVENTION

The present invention relates to a control system for controlling the operation of a steam turbine and, more particularly, to a steam turbine control system which affords a startup of the turbine and a load variation on the turbine in a minimized time, without causing the thermal stress generated in the turbine to exceed a predetermined limit.

As is well known to those skilled in the art, a large thermal stress is caused in the steam turbine, especially at the portion of the rotor confronting the labyrinth packing behind the first stage, when the steam turbine is started up or subjected to a load variation. The larger the rate of change of speed or load becomes, the larger the thermal stress grows. Therefore, from a view point of safe operation of the turbine, a quick startup and an abrupt load change are strictly forbidden.

Meanwhile, there has been proposed and actually carried out a new method of turbine control. According to this method, the startup and the load change of the turbine is made at a rate as large as possible but would never cause a thermal stress exceeding a predetermined limit which has been drawn for each of repeated startup and load change from a view point of observation of the life consumption rate of the turbine. A practical example of this method is proposed, for example, in the specification of U.S. Pat. No. 3,588,265 entitled "System and method for providing steam turbine operation with improved dynamics". Although quite effective in achieving the above stated purpose, unfortunately, this newly proposed method is applicable only to such turbines as having an impulse chamber, because it relies upon a measurement of the temperature in the impulse chamber as a parameter of the turbine control. Thus, this newly proposed method cannot be directly applied to the control of turbines having no impulse chamber. In this newly proposed method, the temperature in the impulse chamber is measured as the parameter or representative of the temperature at the point downstream or behind the first stage, at which the thermal stress is most severe and, therefore, has to be observed strictly.

Thus, for optimumly controlling the steam turbine having no impulse chamber, it is necessary to take one of the alternative measures of measuring directly the steam condition at the point behind the first stage or estimating that condition from the data available at the outside of the turbine. The first-mentioned direct measurement is, however, practically impossible to carry out. Thus, the turbine control is obliged to rely upon the second-mentioned measure, i.e. an estimation.

In the turbine control relying upon this estimation, the following requisites are indispensable.

Firstly, it is essential to make a calculation of the thermal stress at a high precision. This high precision of calculation of thermal stress is required in all conditions of turbine operation including no-load running, load running, putting into synchronous parallel running and so on.

Secondly, the turbine control must be able to startup the turbine safely and without fail. To this end, the steam regulating valve at the turbine steam inlet has to be controlled upon confirmation of not only the instant thermal stress but also the future thermal stress not exceeding the previously drawn limit, because the thermal stress actually appears with certain time lag behind the change of the steaming condition of the turbine. At the same time, the turbine condition has to be relaxed to the safe region without delay, if a thermal stress exceeding the limit or other extraordinary condition is experienced or expected.

Thirdly, the arithmetic or calculation for the estimation of thermal stress and other purposes has to be made by means of digital signals, without necessitating uneconomically large computer. Further, the turbine control system must perform the turbine control at a suitable time interval.

Other improved turbine control systems have been proposed in, for example, in the specification of U.S. Pat. No. 3,446,224 entitled "Rotor Stress Controlled Startup System" and in the specification of U.S. Pat. No. 3,959,635 entitled "System and Method for Operating a Steam Turbine with Digital Computer Control Having Improved Automatic Startup Control Features". However, these improved systems suffer, more or less, the above stated problems of the prior art.

SUMMARY OF THE INVENTION

It is therefore a major object of the invention to provide a turbine control system which affords an estimation of the internal thermal stress of the turbine at a high precision in all operating conditions of the turbine, only from the data available at the outside of the turbine.

It is another object of the invention to provide a turbine control system capable of starting up the turbine and change the load on the turbine safely and without fail, in any case.

It is a further object of the invention to provide a turbine control system which can be managed by a small-power computer.

To these ends, according to the invention, the internal stress actually taking place in the turbine is observed at each control cycle. At the same time, a preestimation of the future stress is carried out every $n_T$ control cycles. The preestimation of the future thermal stress is made for each of a plurality of expected changes of load or turbine speed over a given preestimation period of time, so that the turbine may be operated at the maximum allowable rate of load or speed variation without incurring a thermal stress exceeding the limit $\sigma_L$.

The above and other objects, as well as advantageous features of the invention will become more clear from the following description of the preferred embodiment taken in conjunction with the accompanying drawings.

DESCRIPTION OF THE PREFERRED EMBODIMENTS

Figure 1:
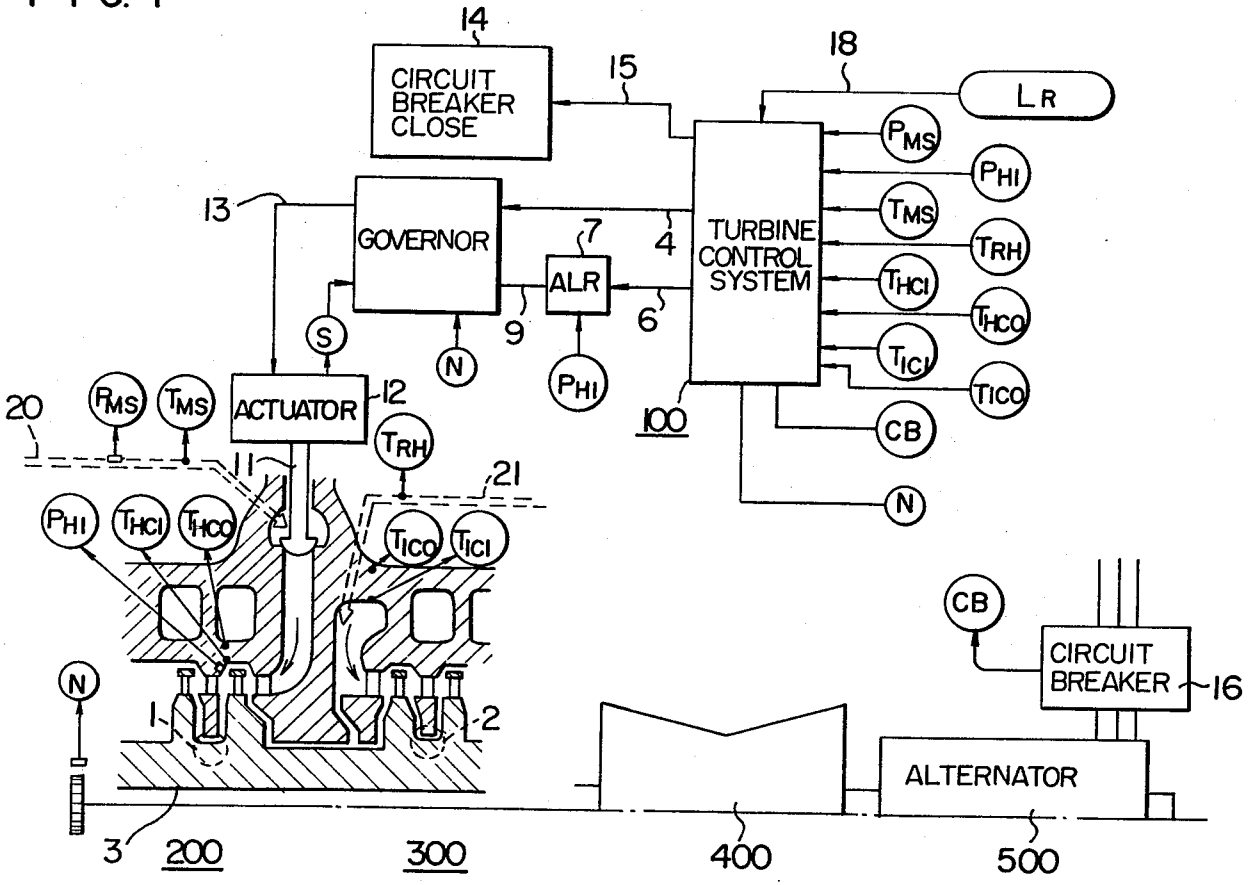
FIG. 1 is an illustration of various signals exchanged between a thermal-stress preestimating turbine control system in accordance with the invention, and a turbine controlled by the system and a control apparatus associated with the turbine.

Referring first to FIG. 1, there are shown various signals exchanged between a thermal-stress preestimating turbine control system 100 embodying the invention and incorporating a digital computer, and a plant and associated controlling apparatus which are controlled by the control system 100. The plant includes a high-pressure turbine 200, an intermediate-pressure turbine 300 and a low-pressure turbine 400, which are adapted to drive an alternator 500 disposed on the same shaft as these turbines.

A high-pressure and high-temperature steam is delivered as the working fluid to the high-pressure turbine 200 from a boiler (not shown) through a steam pipe 20. At the same time, the intermediate-pressure turbine is supplied with a high-pressure and high-temperature steam as a working fluid through a steam pipe 21.

As is well known to those skilled in the art, the working fluid expands while it passes through these turbines, thereby to impart a driving torque to the turbine. As the steam passes through the turbine, a temperature distribution or gradient is caused in the radial direction of the rotor, due to the temperature differential between the working fluid (steam) and the rotor surface, so as to cause a thermal stress.

This thermal stress is most severe at the portion 1 of the high-pressure turbine rotor confronting the labyrinth packing immediately behind the first stage of the high-pressure turbine 200, and at the portion 2 of the intermediate-pressure turbine rotor confronting the labyrinth packing immediately behind the first stage of the intermediate-pressure turbine 300. These portions of the rotors exhibit radial temperature distributions of steep gradients, so as to cause large thermal stresses in the surfaces and bores 3 of respective rotors.

The thermal-stress preestimating turbine control system 100 in accordance with the invention gives the rate of speed increase or acceleration of the turbine and the rate of the load variation which would accomplish the startup or the load variation in the minimized time, while restraining the thermal stress in these metallic portion of the turbine from exceeding the level of predetermined limit.

The turbine control system 100 makes use of the following data as the control inputs, in order to accomplish the above stated function. These data are: temperatures $T_{MS}$, $T_{RH}$ of the steam supplied to the turbine, pressure $P_{MS}$ of the same steam, temperatures $T_{HCI}$, $T_{HCO}$, $T_{ICO}$, $T_{ICI}$ of the metallic parts of the turbine, steam pressure $P_{HI}$ at a point immediately behind the first stage of the high-pressure turbine, operation signal CB of the circuit breaker, revolution speed N of the turbine rotor, and a command load signal $L_R$.

The basic function of the control system 100 in accordance with the invention is to determine the maximum allowable speed-increasing rate 4 or the maximum allowable rate of load variation 6, which would never cause the internal thermal stress to exceed the predetermined limit, at the time of startup or load variation of the turbine, and to deliver them to a governor 10 or to an ALR (Automatic Load Regulator) 7, as the setpoints.

The signal $P_{HI}$ of the steam pressure at behind the first stage is fed back to the ALR, as a signal representative of the turbine output. The ALR 7 in turn delivers an instantaneous command load 9 to the governor 10, to which fed back is the speed signal N. The governor finally delivers a valve-position instruction to an actuator 12 for controlling the opening of a main steam regulating valve 11.

Further, the control system 100 in accordance with the invention makes a judgement, taking the thermal stress into account, as to whether the turbine may be put into loaded operation. Thus, the control system 100 delivers, upon judging that the turbine can be safely loaded, a loading allowance 15 to a loading facility 14 which is adapted to put the alternator into the synchronous parallel loaded operation.

The invention aims at achieving a quick startup and prompt load follow-up of the turbine, by the procedure as stated in detail hereinafter, on the basis of the heat-transfer characteristics of the portions 1, 2 of the rotor facing the labyrinth packings, and a preestimating calculation of the thermal stress expected on the rotor.

The practical embodiment of the invention will be described hereinunder. At first, the general idea of the invention will be explained with specific reference to FIG. 2, and then, detailed description will be made as to each of the facilities.

Figure 2:
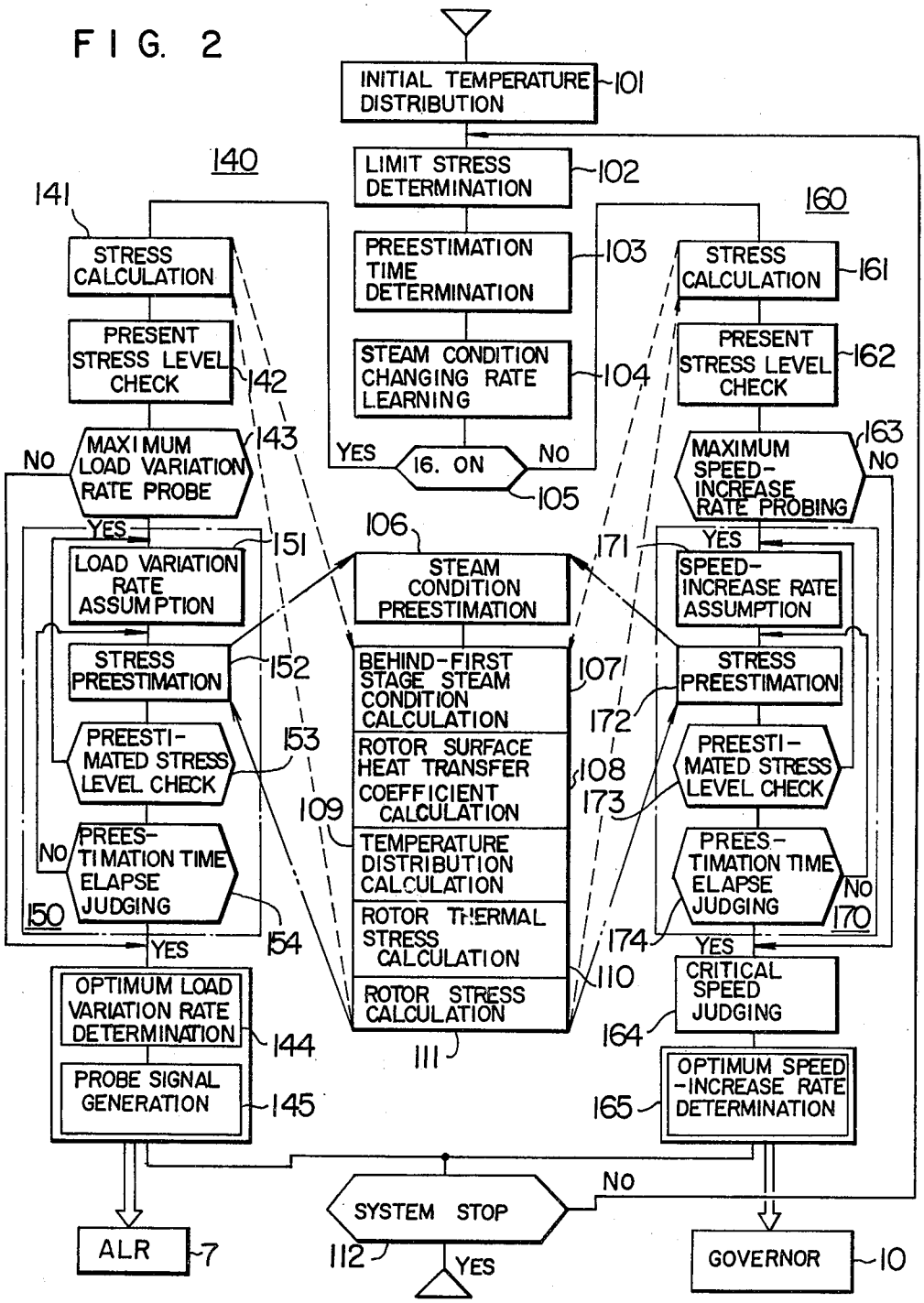
FIG. 2 is a schematic illustration of signal processing procedure as performed in the control system in accordance with the invention.

Referring to FIG. 2 schematically showing the procedure of the processing performed by the thermal-stress preestimating turbine control system 100 of the invention, at first the initial temperature is determined by an initial temperature distribution determining facility 101. This facility 101 estimates the temperature distribution over the turbine rotors from the actually measured temperatures of the portions of the turbines which have substantially equal wall thickness to the metals of respective rotors and which exhibit similar temperature distributions to the metals of respective rotors. Thus, the actually measured temperatures $T_{HCI}$, $T_{HCO}$ of the inside and outside surfaces of casing behind the first stage are used for estimating the temperature distribution of the high-pressure turbine rotor, while acutally measured temperatures $T_{ICO}$, $T_{ICI}$ of the outer and inner walls are used as the data for estimating the intermediate-pressure turbine rotor.

A stress-limit determining facility 102 is adapted to determine a limit of stress $\sigma_L$ which is defined by the allowable life consumption rate of the rotor corresponding to each of various startup modes such as startup from very hot state, startup from hot state, startup from warm state, startup from cold state of the turbine and so on. A specifically severe stress limit $\sigma_L$ is drawn at the initial period of the startup, as will be explained later, in order to compensate for a possible error of estimation of initial temperature distribution, when the turbine is quickly restarted or when the computer is instantaneously put into on-line control for turning the computer control into effect from the midway of the turbine control.

A preestimation time determining facility 103 is adapted to determine the time length starting from the present instant, over which the stress is to be preestimated. This preestimation time $t_P$ is determined suitably in accordance with the steam generating condition of the boiler and the turbine startup sequence.

A steam condition changing rate learning facility 104 is a facility to grasp the dynamic characteristic of the boiler at the present stage in relation with the running condition of the turbine. More specifically, this facility is to grasp, from actually measured values of the steam conditions at the turbine inlet (main steam inlet temperature, main steam inlet pressure and reheated steam inlet temperature), the rate at which the steam condition have been changed in relation with the change of the turbine speed or the load variation on the turbine. The result of this learning is used by a steam condition preestimation facility 106 which will be mentioned later.

A running mode judging facility 105 is adapted to make a judgement, by means of an ON-OFF state signal CB delivered from the circuit breaker 16, as to whether the present running mode is the speed control mode or the load control mode. This facility 105 switches the flow of processing to a speed control system 160 when it judges the present running mode as being the speed control mode, and to a load control system 140 when it judges the present running mode as being the load control mode.

When the speed control system 160 is selected, at first the present stress level $\sigma$ in the rotor is measured by a present stress estimation facility 161. This present stress estimation facility 161 consists of a facility 107 for calculating the steam condition behind the first stage, facility 108 for calculating the heat transfer coefficient of the rotor surface, a facility 108 for calculating the temperature distribution in the rotor, a facility 110 for calculating the thermal stress in the rotor and a facility 111 for calculating the stress taking the centrifugal stress into account.

A present stress-level checking facility 162 is adapted to judge whether the present stress as estimated by the facility 161 is lower than the limit $\sigma_L$ as obtained by the function 102. The present turbine speed is maintained, as a rule, when the present stress $\sigma$ at least a portion of the rotor is found to exceed the limit $\sigma_L$.

The subsequent calculation mode judging facility 163 judges whether the present situation of calculation requires a probing of maximum speed-increasing rate on the basis of the preestimation calculation or not. If it is judged by this facility 163 that the present situation requires the probing of the maximum speed-increase rate, this facility 163 delivers the process to a maximum speed probing facility 170. To the contrary, if it is judged that the present situation is not for the probing of the maximum speed-increase rate, the facility 163 delivers the processing to a critical speed judging facility 164, bypassing the facility 170. There is a relationship represented by $\tau_2 = n_T \tau_1$ ($n_T$ is an integer), between the processing period $\tau_1$ of the present stress estimating facility 161 and the processing period $\tau_2$ of the maximum speed probing facility 170. For instance, the processing period $\tau_2$ is 3 minutes, when the processing period $\tau_1$ and the integer $n_T$ are one minute and 3, respectively.

The maximum speed-increase rate probing facility 170 has a speed-increase assuming facility 171, stress preestimating facility 172, preestimated stress level checking facility 173 and a facility 174 for judging that the preestimation time has been reached. Further, the stress preestimating facility 172 includes minor facilities for steam condition preestimation 106, behind-first stage steam condition calculation 107, rotor-surface heat transfer coefficient calculation 108, rotor temperature distribution calculation 109, rotor thermal stress calculation 110 and rotor stress calculation 111. The minor facilities 107, 108, 109, 110 and 111 are similar to those of the facility 161.

The probing of the maximum speed-increase rate by the facility 170 is conducted in the following manner. At first, a plurality of speed-increase rate $\mathring{N}1$, $\mathring{N}2$, . . . $\mathring{N}x$ . . . $\mathring{N}p$ (rpm/m) are prepared. The largest one of these speed-increase rates is then assumed by the speed-increase rate assuming facility 171, and the future stress, which would be caused when the turbine is accelerated at this rate, is preestimated up to the time $t_P$ which has been determined by the preestimation time determining facility 103. More specifically, at first the stress at the instant $\tau_1$ after the present time is preestimated, taking also the behind-first stage steam condition into account. If this preestimated stress is found not to exceed the limit stress $\sigma_L$, the stress preestimation is made for the next period $\tau_1$. This estimation is repeated for each of successive periods $\tau_1$, until the aforesaid preestimation time $t_P$ is reached. If the limit stress $\sigma_L$ is not reached by the preestimated stress until the preestimation has proceeded to the aforesaid preestimation time $t_P$, this rate of the speed-increase as assumed by the facility 170 is adopted as the maximum allowable rate of speed increase, i.e. the largest speed-increase rate which would never cause an excessive internal stress. However, when the aforesaid limit stress $\sigma_L$ is reached by the preestimated stress on the way of the preestimation up to the preestimation time $t_P$, the speed-increased rate as assumed by the facility 170 cannot be adopted. In such a case, a similar preestimation calculation and evaluation is made for the next speed-increase rate. If this newly assumed speed-increase rate does not cause the preestimated stress to exceed the stress limit $\sigma_L$, this rate is adopted as the maximum allowable speed-increase rate.

The aforementioned critical speed judging facility 164 is a function for judging whether the present speed falls within the range of the critical speed of the turbine.

An optimum speed-increase determining facility 165 has a function to set in the governor 10 the maximum allowable speed-increase rate as probed by the maximum speed-increase rate probing facility 170. However, when the present turbine speed N is within the critical speed range, the speed-increase rate is not changed, and the turbine speed is increased at a rate obtained by the previous calculation. At the same time, the present turbine speed is maintained irrespective of the result of the probing of the maximum allowable speed-increase rate, when the estimated present stress as obtained by the facility 161 comes to exceed the limit stress $\sigma_L$. However, even in the latter case, the turbine speed is increased at the previously obtained rate, if the present turbine speed N is within the range of critical speed.

The running mode is shifted from the speed control system 160 to the load control system 140, as the load is applied to the turbine by a closing of the circuit breaker 16, after the desired turbine speed is obtained. The facilities 140 and 160 have substantially same functions and processing procedures, although they are bound for different objects of load and speed.

The load control system has a present stress estimating facility 141 adapted to estimate the present stress of the rotor. This function 141 includes minor facilities of behind-first stage steam condition calculation 107, rotor surface heat transfer coefficient calculation 108, rotor temperature distribution calculation 109, rotor thermal stress calculation 110 and rotor stress calculation 111 which are similar to those of the facility 161 included by the speed control system 160.

The present stress level checking function 142 is adapted to judge whether the estimated present stress is lower than the limit stress $\sigma_L$. The present load level is held, if at least one of the estimated stress is found to exceed the limit stress. Thus, the facility 142 has the same function as the facility 162.

The calculation mode judging facility 143 makes a judgement as to whether the present situation of calculation requires the probing of the maximum allowable load variation rate on the basis of the preestimating calculation. If it is judged that the probing of the maximum allowable load variation rate is necessary, the facility 143 functions to deliver the processing flow to a maximum load variation rate probing facility 150. To the contrary, if it is judged that probing is not necessary, the processing flow is delivered to a maximum load variation determining facility 144, bypassing the facility 150. There is a relationship as represented by an equation of $\tau_2 = n_T \tau_1$ ($n_T$ is an integer), between the processing period $\tau_1$ of the present stress estimating facility 141 and the processing period $\tau_2$ of the maximum load variation rate probing facility 150. The periods $\tau_1$, $\tau_2$ and the integer $n_T$ are similar to those of the facility 163. The facility 143 is a facility corresponding to the facility 163 of the speed control system 160.

The maximum load variation rate probing facility 150 includes a load variation rate assuming facility 151, stress preestimating facility 152, preestimated stress level checking facility 153 and a facility 154 for judging that the preestimation has proceded to the peviously given preestimation time. Thus, the facilities 150, 151, 152, 153 and 154 correspond to the facilities 170, 171, 172, 173 and 174 of the speed control system, respectively.

Further, the stress presstimating facility 152 includes minor facilities of steam condition preestimation 106, behind-first stage steam condition calculation 107, rotor surface heat transfer coefficient calculation 108, rotot temperature distribution calculation 109, rotor thermal stress calculation 110 and rotor stress calculation 111, all of which are used commonly by the facility 152 and by the facility 172 of the speed control system 160.

The maximum load variation rate probing function 150 is adapted to probe the maximum allowable load variation rate, through successive assumptions of a plurality of load variation rates $\pm\dot{L}1$, $\pm\dot{L}2$, . . . $\pm\dot{L}x$ . . . $\pm\dot{L}p$ (%/min.), from the largest one to the next, by the load variation rate assuming facility 151, up to the ending of the preestimation time $t_P$ which has been previously obtained by the preestimation time determining facility 103. Thus, the facility 150 performs the probing of the maximum allowable load variation rate in the same procedure as that for determining the maximum allowable speed-increase rate.

The optimum load variation rate determining facility 144 has a function to set in the ALR 7 the maximum allowable load variation rate as probed by the maximum load variation rate probing facility 150. This facility 144, however, delivers an instruction for maintaining the present level of the load, i.e. the signal representative of load variation rate being zero to the ALR 7, when the main stream temperature or the reheated steam temperature is lower than a predetermined temperature. At the same time, this facility 144 functions to hold the present level of load, irrespective of the result of the maximum load variation rate probing, when the estimated present stress has come to exceed the limit stress.

The probe signal generating facility 145 is a facility to render the learning function of the steam condition charging rate learning facility 104, in the course of increase of the load after the startup, thereby to smoothen the increase of the load.

As has been described, a smooth and quickest startup of the turbine and promptest load running control of the turbine can be achieved by the functioning of the stress limit determining facility 102 and the preestimation time determining facility 103, as well as by the repeated functioning of the facilities of the speed control system 160 or load control system 140, at a period $\tau_1$ of repetition. This repeated functioning of the facilities is continued until a demand for stopping the system becomes available at a system stop deciding facility 112.

Hereinafter, the detail of the described facilities will be described in order.

At first, the initial rotor temperature distribution determining facility 101 will be described with specific reference to FIGS. 3, 4. It is quite difficult to actually measure the temperature distribution in the rotor. However, it is quite important and essential, for the turbine control system of the invention focussed on the safe control of quick startup and abrupt load variation of the turbine, to obtain the initial temperature distribution in the rotor at a high precision.

Figure 3:
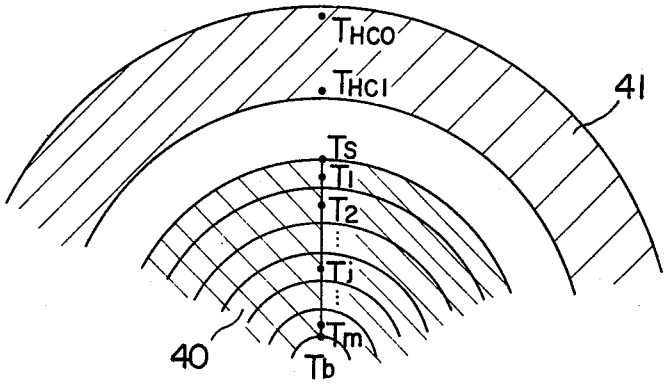
FIG. 3 is a cross-sectional view of a turbine rotor and associated turbine casing taken along the plane including a point immediately behind the first stage of the turbine, showing a temperature distribution over the cross-section.

FIG. 3 is a cross-sectional view of the rotor 40 and casing 41, taken along a plane perpendicular to the axis of the rotor shaft and containing the portion 1 confronting the labyrinth packing. In FIG. 3, symbols $T_{HCO}$, $T_{HCI}$, Ts, Tb and Tj (j being integers which are l to m) represent, respectively, the temperatures of the outer surface metal of the casing, the inner surface metal of the casing, surface metal of the casing, surface of the rotor, rotor bore and each of imaginary concentric annular sections l to m of the rotor.

Among these temperatures, only the temperature $T_{HCO}$ and $T_{HCI}$ can be obtained by a direct temperature measurement, while Ts, Tb and Tj are to be obtained by an estimation.

Although the observation of the thermal stress, according to the invention, is made at both of the portions 1 and 2 of high-pressure and intermediate-pressure turbine rotors confronting the labyrinth packings behind the respective first stages, the following description will be made exemplarily as to the high-pressure turbine, because the observation of the thermal stress in the intermediate-pressure turbine can be performed substantially in the same way as the high-pressure turbine. However, the observation of the thermal stress on the intermediate-pressure turbine differs from that on the high-pressure turbine in some minor aspects. These different aspects will be pointed out at each time it becomes necessary.

For instance, in case of the facility 101, the difference resides in that the observationn for the intermediate-pressure turbine makes use of the temperatures $T_{ICO}$ and $T_{ICI}$ of the steam chamber wall, while the observation for the high-pressure turbine makes use of the temperature $T_{HCI}$ and $T_{HCO}$ of the casing.

Figure 4:
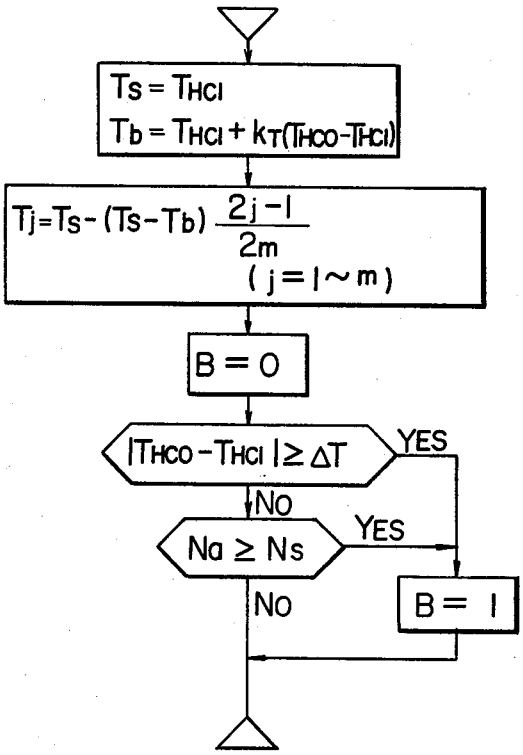
FIG. 4 is an illustration showing how the initial temperature distribution over the rotor is determined.

FIG. 4 illustrates the practical procedure of the process performed by the initial temperature distribution determining facility 101.

As this system is started, the radial temperature distribution in the rotor is estimated from the actually measured temperatures $T_{HCI}$ and $T_{HCO}$ of the inner and outer surfaces of the turbine casing.

In the course of this estimation, the temperatures Ts and Tb are regarded as follows, respectively.

$$Ts = T_{HCI} \quad (1)$$

$$Tb = T_{HCI} + Kr\,(T_{HCO} - T_{HCI}) \quad (2)$$

The above-mentioned Kr in equation (2) is a constant which is determined by the shape of the turbine. The temperature distribution in the rotor is considered to be obtainable by a primary interpolation of the temperatures Ts and Tb. Thus, the temperature Tj of the annular sections are given by the following equation (3).

$$Tj = Ts - (Ts - Tb)\frac{2j-1}{2m} \quad (3)$$

The above explained estimation is made on the assumption that the casing and the rotor after the stop of the turbine is cooled down from the side closer to the ambient air, i.e. from the outer surface of the casing, and that a substantially linear temperature gradient is established along the radius of the turbine between the coldest outer surface of the casing and the hottest bore of the rotor.

This way of estimation can estimate the temperatures Tj of respective sections of the rotor at a considerably high precision, when the turbine is started after a sufficiently long suspension, because the difference between the temperatures $T_{HCO}$ and $T_{HCI}$ is sufficiently small in such a case. However, when the turbine is restarted after a short suspension, the temperature distribution in the turbine rotor is not exactly estimated because the difference between the temperatures $T_{HCO}$ and $T_{ICO}$ is considerably large. Consequently, in the latter case, an error is likely to be caused in the estimation of the thermal stress immediately after the start.

The facility 101 of the system of invention can descriminate whether it is considereed that the estimation of the thermal stress soon after the start includes a large error or not. In FIG. 3, a symbol B is a variable representative of the magnitude of the gradient of temperature distribution in the radial direction of the rotor. As started before, the error involved in the stress estimation becomes large as the gradient becomes large. The variable B assumes a value 1 when the temperature differential $|T_{HCO} - T_{HCI}|$ is larger than a predetermined value $\Delta T$, and assums a value 0 (zero) when the temperature differential is smaller than the predetermined value. At the same time, the variable B is made to assume the value 1 when the present turbine speed Na is greater than a standard speed Ns, because in such a case the stress estimation is likely to involve a large error even if the temperature difference is small. The value of the variable B is used as a reference in the limit stress determining facility 102 which performs the subsequent function.

The limit stress determining facility 102 is a facility for determining the limits of the stresses at the rotor surface and the rotor bore. The limit value used as the basis of this function is determined optionally by the operator or, alternatively, objectively from a view point of life consumption rate. However, since the stress estimation at the time soon after the start is likely to involve error, as stated before, the level of the limit stress is made more severe tentatively, so as to effect a safe stress control, in case that the level of the variable B is 1.

Figure 5:
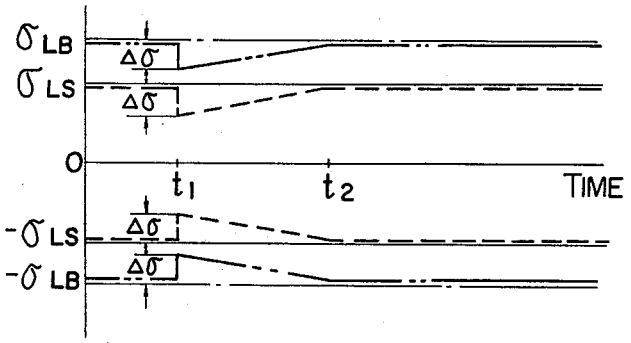
FIG. 5 is an illustration showing how the limit of the internal stress is determined in relation with the rotor surface and bore.

This function will be described with reference to FIG. 5. It is assumed here that the turbine is started at an instant t1. In case that the gradient of the initial temperature distribution in the rotor is small, i.e. when B equals 0 (zero), the limit stress is kept constant at a level $\sigma_L$ as given by the operator. For information, this limit stress appears on the rotor surface and the rotor bore as $\pm\sigma_{LS}$ and $\pm\sigma_{LB}$, respectively. However, when the variable B assumes the value 1, a level smaller by $\Delta\sigma$ at the maximum than the level given by the operator is used as the limit stress, for a safer control. A value necessary for compensating for the error of initial stress estimation is selected and used as the value $\Delta\sigma$. The value $\Delta\sigma$ is made smaller as the time elapses, because the error of the temperature distribution estimation error decreases as the time elapses. Finally, the value $\Delta\sigma$ is made equal zero at the instant t2.

Referring now to the preestimation time determining facility 103, this facility has a function to determine the time length starting from the present instant, over which the preestimation of the future thermal stress is to be made by the facilities 170 and 150 of FIG. 2.

Figure 6:
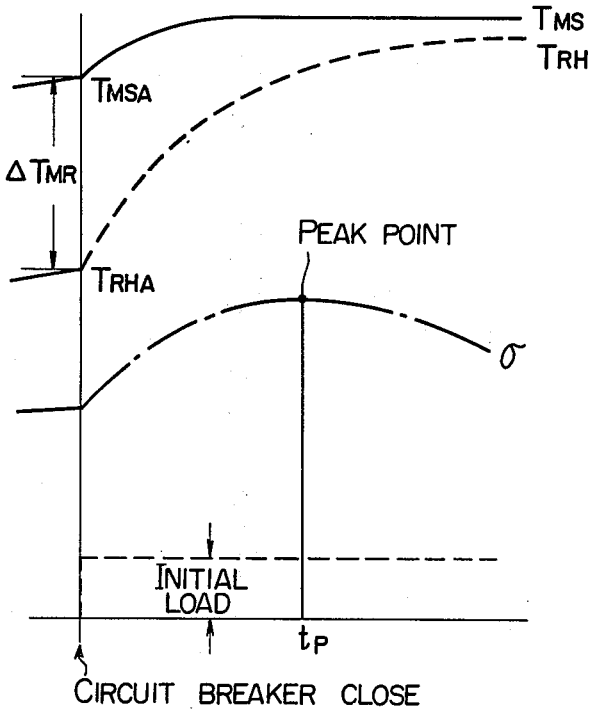
FIG. 6 shows the relationship between the dynamic characteristic of the steam temperature $T_{MS}$, $T_{RH}$ at turbine inlet and the resulting thermal stress, as observed immediately after putting the alternator driven by the turbine into synchronous parallel running.
Figure 7:
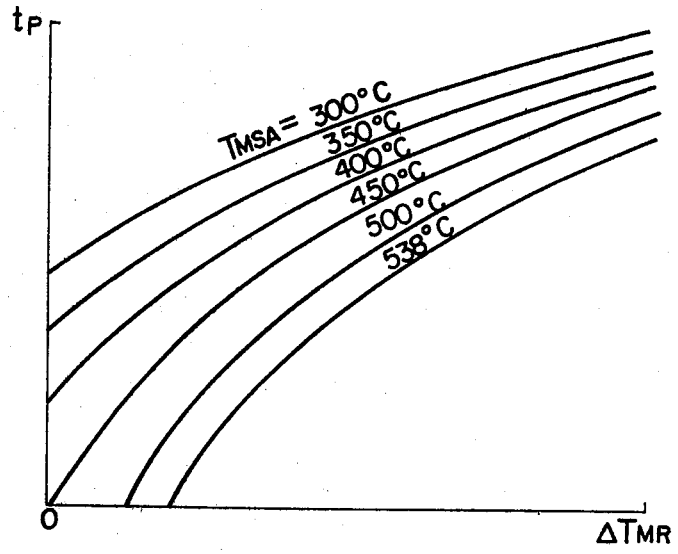
FIG. 7 shows the characteristics for determining the preestimation time before putting the alternator into parallel synchronous running.

One of the most important factors for determining the preestimation time $t_p$ is the behaviour of the reheated steam temperature $T_{RH}$ immediately after the closing of the circuit breaker 16. When the circuit breaker 16 is closed, the fuel supply to the boiler is increased in a stepped manner, because the initial load is applied to the turbine. Consequently, as shown in FIG. 6, the temperature of the reheated steam is abruptly increased, and tends to follow up the main steam temperature with a primary lag. Consequently, the stress in the rotor of the intermediate-pressure turbine possibly goes on to increase even if the level of the initial load is held. In such a case, the time length $t_P$ (the time until the largest thermal stress is established) varies depending on the main steam temperature $T_{MS}$ and reheated steam temperature $T_{RH}$. This situation is illustrated in FIG. 7. In FIG. 7, $T_{MR}$ represents the temperature differential $b.T_{MSA}-T_{RHA}$, i.e. the value given by the equation of $T_{MR}=b.T_{MSA}=T_{RHA}$, where $T_{MSA}$ and $T_{RHA}$ represent, respectively, the values of temperatures $T_{MS}$ and $T_{RH}$ at an instant immediately after the closing of the circuit breaker. It will be seen from FIG. 7, that the preestimation time $t_p$ can be made shorter as the differential $T_{MR}$ is made smaller and as the main steam temperature $T_{MSA}$ is made higher.

Since the length of the preestimation time is largely changed at the time of closing of the circuit breaker, as described above, the above stated phenomenon is quantitatively preestimated before closing the circuit breaker. The circuit breaker closing allowance instruction 15 is delivered to the circuit breaker closing facility 14 only after confirming that the stress caused by the above stated phenomenon does not exceed the limit stress. To this end, the time $t_p$ at which the stress $\sigma$ comes to take its peak value as shown in FIG. 6, when the initial load is held constant, is calculated as the minimum required preestimation time.

Figure 8:
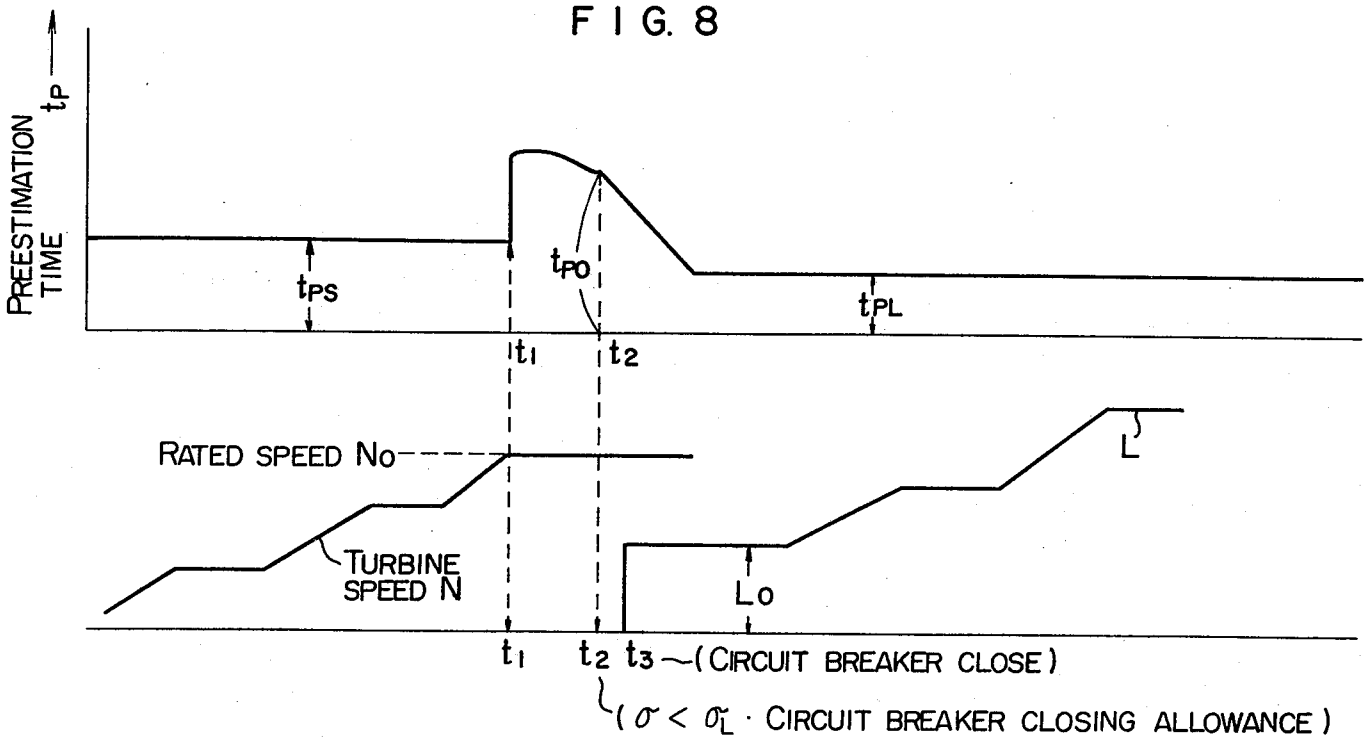
FIG. 8 shows how the preestimation time varies at the time of startup of the turbine.

FIG. 8 shows how the preestimation time $t_p$ is changed in the course of the speed increase and load increase. The preestimation time $t_p$ may take a constant value $t_{ps}$ while the turbine speed is being increased. As the turbine speed reaches the rated speed at an instant $t_1$, the facility 103 turns to the calculation of the preestimation time $t_p$, on the assumption that the circuit breaker 16 is closed at that instant $t_1$, in accordance with the following equation.

$$t_p = a \log_e \frac{d}{b \cdot T_{MSA} - T_{RHA} + C} \tag{4}$$

The above equation (4) simulates the characteristics as shown in FIG. 7. Symbols a, b, c and d are constants which are determined by the dynamic characteristics of the boiler and the turbine, while the symbols $T_{MSA}$ and $T_{RHA}$ represent the values of $T_{MS}$ and $T_{RH}$ at that instant $t_1$. The preestimation time $t_p$ thus obtained at the instant $t_1$ is used by the facility 170 in preestimating the thermal stress $\sigma$, because the circuit breaker has not been actually closed yet at that instant $t_1$. The facility 170 preestimate the thermal stress $\sigma$ over the preestimation time of $t_p$, on the assumption that an initial load of, for example 3% load is going to be applied to the turbine, and, if it is confirmed that the limit stress $\sigma_L$ is not exceeded by the stress $\sigma$ in that period, delivers the circuit breaker closing allowance instruction 15 to the circuit breaker closing facility 14. The circuit breaker closing facility 14 is a facility to provide an instruction to close the circuit breaker 16, upon confirming the coincidence of the voltage, frequency and the phase of the output power of the alternator 500 driven by the present turbine, with those of the external power line (not shown), as is well known to those skilled in the art. Thus, according to the invention, the circuit breaker closing facility 14 delivers only when both of above stated coincidence and the aforementioned circuit breaker closing allowance instruction 15 are obtained. However, if it is expected that the future thermal stress $\sigma$ exceeds the limit stress $\sigma_L$, the preestimation time $t_p$ is determined again after an elapse of a predetermined time from the instant $t_1$. Thus, FIG. 8 shows that the condition of $\sigma<\sigma_L$ has been obtained since the instant $t_2$. Consequently, the circuit breaker closing allowance instruction 15 is delivered to the circuit breaker closing facility 14 at the instant $t_2$, and the circuit breaker is actually closed at a subsequent instant $t_3$ to impose an initial load Lo on the turbine.

The preestimation time $t_p$ in the load running mode is basically fixed at a constant value $t_{pL}$. However, as stated before with reference to FIG. 6, there is an increase of the temperatures $T_{MS}$ and $T_{RH}$ at the period immediately after the closing of the circuit breaker, so that the preestimation time $t_p$ is not instantaneously reduced to $t_{pL}$ but is decreased gradually to $t_{PL}$.

Referring now to the steam condition changing rate learning facility 104, the subjects of the learning are the changing rate of three thermodynamic functions of the main steam temperature $T_{MS}$, main steam pressure $P_{MS}$ and reheated steam temperature $T_{RH}$ in relation with the amounts of change of speed N or load L. More specifically, there are six subjects of $dT_{MS}/dN$, $dT_{RH}/dN$, $dP_{MS}/dN$, $dT_{MS}/dL$, $dT_{RH}dL$ and $dP_{MS}/dL$. The former three subjects are used in the speed control mode, while the latter three subjects are used for the load control mode. These are utilized by the facility 170 in preestimating the stress. How they are utilized will be described in detail later, in relation with the description of the facilities 172, 152.

The learning is made in accordance with the following equations.

$$\frac{dT_{MS}}{dN} = \frac{T_{MS(t)} - T_{MS(t-n\tau 1)}}{N(t) - N(t - n\tau_1)} \tag{5}$$

$$\frac{dT_{RH}}{dN} = \frac{T_{RH(t)} - T_{RH(t-n\tau 1)}}{N(t) - N(t - n\tau_1)} \tag{6}$$

$$\frac{dP_{MS}}{dN} = \frac{P_{MS(t)} - P_{MS(t-n\tau 1)}}{N(t) - N(t - n\tau_1)} \tag{7}$$

$$\frac{dT_{MS}}{dL} = \frac{T_{MS(t)} - T_{MS(t-n\tau 1)}}{L(t) - L(t - n\tau_1)} \tag{8}$$

$$\frac{dT_{RH}}{dL} = \frac{T_{RH(t)} - T_{RH(t-n\tau 1)}}{L(t) - L(t - n\tau_1)} \tag{9}$$

$$\frac{dP_{MS}}{dL} = \frac{P_{MS(t)} - P_{MS(t-n\tau 1)}}{L(t) - L(t - n\tau_1)} \tag{10}$$

Above equations (5), (6) and (7) are adopted when $dN/d_t$ is not equal to 0 ($\neq 0$), while equations (8), (9) and (10) are adopted when $dL/d_t$ is not equal to 0 ($\neq 0$).

Figure 9:
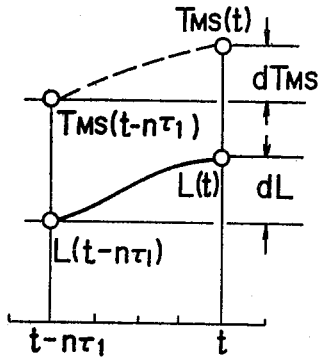
FIG. 9 is an illustration showing the procedure of learning of steam-condition changing rate.

FIG. 9 illustrates the concept of $dT_{MS}/dL$. The $dT_{MS}/dL$ is the difference between the $T_{MS(t)}$ at the instant t and the $T_{MS(T-n\tau 1)}$ at an instant $(t-n\tau_1)$. Similarly, the dL is the difference between L(t) and $L(t-n\tau_1)$ at these instants.

The above equations (5) to (10) cannot be used when dN/dt and dL/dt are equal to 0, i.e. when the speed or the load is constant, because the denominators of fractions are zero to make the values of these fractions indefinite. For this reason, according to the invention, the values obtained by these equations (5) to (10) are gradually decreased, in accordance with the following equations.

$$\frac{dT_{MS}}{dN} = (1 - \frac{\tau_1}{\tau_F})(\frac{dT_{MS}}{dN})$$

-continued $$\frac{dT_{MS}}{dL} = (1 - \frac{\tau_1}{\tau_F})(\frac{dT_{MS}}{dL})$$

In the above equations, $\tau_F$ represents a constant given by $\tau_1 < \tau_F$. Thus, a so-called memory-lapse characteristic is realized, when the load or the speed is kept constant, by gradually decreasing the values obtained by the learning.

Hereinafter, a description will be made as to various facilities used when the circuit breaker 16 is not closed, i.e. the facilities belonging to the speed control system.

Referring first to the present stress estimating facility 161, this facility includes minor facilities of behind-first stage steam condition calculation 107, rotor surface heat transfer coefficient calculation 108, rotor temperature distribution calculation 109, rotor thermal stress calculation 110 and rotor stress calculation 111, all of which are commonly used by the facility 161 and by the load control system.

At first, the function of the behind-first stage steam condition calculation facility 107 will be described.

For the calculation of the thermal stress, it is essential to grasp the condition of the steam flowing into the portions 1 and 2 of rotors confronting respective labyrinth packings where the thermal stress is most critical and, therefore, have to be observed. In other words, it is necessary to know the steam condition at the portion of the rotor behind the first stage. However, it is almost impossible to actually measure the steam condition at that portion or, even if possible, the measurement sustains a considerable error and time lag.

To this end, according to the invention, the behind-first stage steam pressures and temperatures $P_{H1}$, $P_{I1}$, $T_{H1}$, $T_{I1}$ are calculated from main steam condition $P_{MS}$, $T_{MS}$, turbine speed N, speed increasing rate $\mathring{N}$, load L and reheated steam temperature $T_{RH}$, for the high-pressure and intermediate-pressure turbines, respectively.

Figure 10:
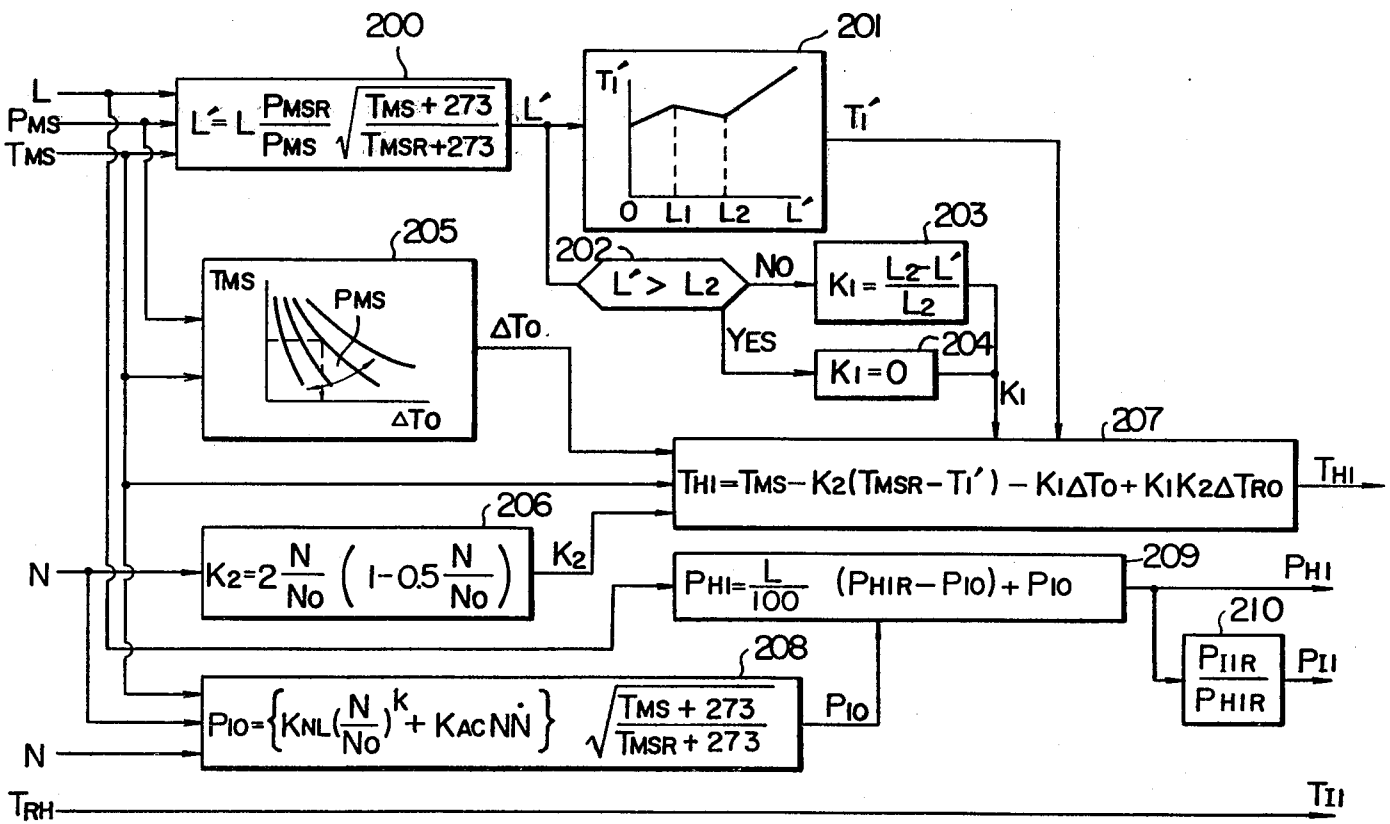
FIG. 10 is an illustration showing the procedure of preestimation of the steam condition at a point in the turbine immediately behind the first stage.

FIG. 10 illustrates a procedure for estimating the steam condition from the condition of the steam generated by the boiler and from the running condition of the turbine. By using the data of main steam temperature $T_{MS}$, main steam pressure $P_{MS}$, reheated steam temperature $T_{RH}$, speed N, speed increasing rate $\mathring{N}$, and the load L as the input variables, this procedure can be used continuously over the entire part of the turbine control, from the starting up to the usual running in the loaded condition. However, the behind-first stage steam temperature of the intermediate-pressure turbine is regarded as being equal to the actually measured reheated steam temperature, for the safety's sake. Namely, it is assumd that there is no temperature drop actoss the first stage of the intermediate-pressure turbine.

Hereinafter, the functions of each facility as shown in FIG. 10 will be described.

It is assumed here that the level of the load L is zero in the no-load running, and the turbine speed N and speed increase rate $\mathring{N}$ in the loaded running condition are No and zero, respectively.

At first, an explanation will be made as to how the behind-first stage steam temperature $T_{HI}$ is derived. To this end, first of all, block 200 calculates the equivalent load L8 under the rated steam condition (rated main steam temperature $T_{MSR}$ and rated main steam pressure $P_{MSR}$). The equivalent load L' is zero during the speed-increase of the turbine, i.e during the no-load running of the turbine. Then, the behind-first stage steam temperature Ti' corresponding to the load L' is obtained. Symbols L1 and L2 represent the lower limit and upper limit loads in case of a combined governing. Then, the steam throttling ratio K1 of the turbine inlet main steam regulating valve 11 corresponding to the load L' is obtained by the blocks 202, 203 and 204. However, the ratio K1 is made zero when the equivalent load L' is greater than the upper limit load L2, because in such a case the regulating valve 11 is operated at a partial arch admission. The block 205 calculates the temperature differential ΔTo between the main steam temperature $T_{MS}$ and the steam temperature in the turbine bowl, from $P_{MS}$ and $T_{MS}$. In the function of the block 205, the temperature differential ΔTo becomes larger as the pressure $P_{MS}$ becomes greater, assuming that the temperature $T_{MS}$ is constant. The block 206 calculates, from an input of the turbine speed N, the temperature reducing factor K2 across the first stage of the highpressure turbine. In the function of the block 206, No represents the rated speed. The factor K2 is a value represented by $0 \leqq K2 \leqq 1$ and is 1 (one) when the turbine is operated at the rated speed and during the loaded operation of the turbine. Finally, the behind-first stage steam temperature $T_{HI}$ of the first stage is obtained by the block 207. The temperature $T_{HI}$ is determined as a value obtained by subtracting the temperature drop of the steam on the way to the portion behind the first stage, from the main steam temperature $T_{MS}$. In the function of the block 207, $K_2(T_{MSR} - \tau_1')$ is the steam temperature drop across the first stage, while K1 ΔTo represents the temperature drop across the regulating valve 11. At the same time the symbol $\Delta T_{Ro}$ represents the temperature differential between the main steam temperature and the steam temperature in the turbine bowl, under the rated steam condition.

Hereinafter, an explanation will be made as to the procedure for obtaining the behind-first stage steam pressure $P_{H1}$. At first, a behind-first stage steam pressure $H_{10}$ of the high-pressure steam turbine corresponding to no-load operation is obtained by the block 208. In the function of the block 208, $K_{NL}$ denotes the behind-first stage steam pressure of the high-pressure turbine corresponding to the no-load pressure drop at the rated turbine speed, K denotes a no-load pressure drop index number, and $K_{AC}$ denotes the pressure required for obtaining a unit acceleration. The block 209 determines the behind-first stage steam pressure $P_{H1}$ of the high pressure turbine upon receipt of $P_{10}$ and L as the inputs. $P_{H1R}$ denotes the behind-first stage steam pressure at the rated load running of the turbine.

The block 210 determines the behind-first stage steam pressure $P_{I1}$ of the intermediate-pressure turbine. The pressure $P_{I1}$ is obtained by multiplying the pressure $P_{H1}$ by the ratio $P_{I1R}/P_{H1R}$ of the behind-first stage steam pressure $P_{H1R}$ of the high-pressure turbine at the rated load to that $P_{I1R}$ of the intermediate-pressure turbine.

Finally, the steam temperature at the intermediate-pressure turbine inlet i.e. the reheated steam temperature, is directly used as the behind-first stage steam temperature $T_{I1}$ of the intermediate-pressure turbine.

According to the invention, the steam conditions at portions behind the first stages of the high-pressure and intermediate-pressure turbines are calculated and estimated in above stated procedure. In FIG. 10, the units of N and No is (rpm), while the unit for the speed increasing rate $\mathring{N}$ is (rpm/m). The load L is given as a ratio (%) to the rated load. The unit of the temperature represented by T is (°C.), while the pressures represented by P and $K_{NL}$ have a unit of (ata). Further, the unit of $K_{AC}$ is (ata/(rpm$^2$/m)). Factors K1, K2 and k have no dimension.

Figure 11:
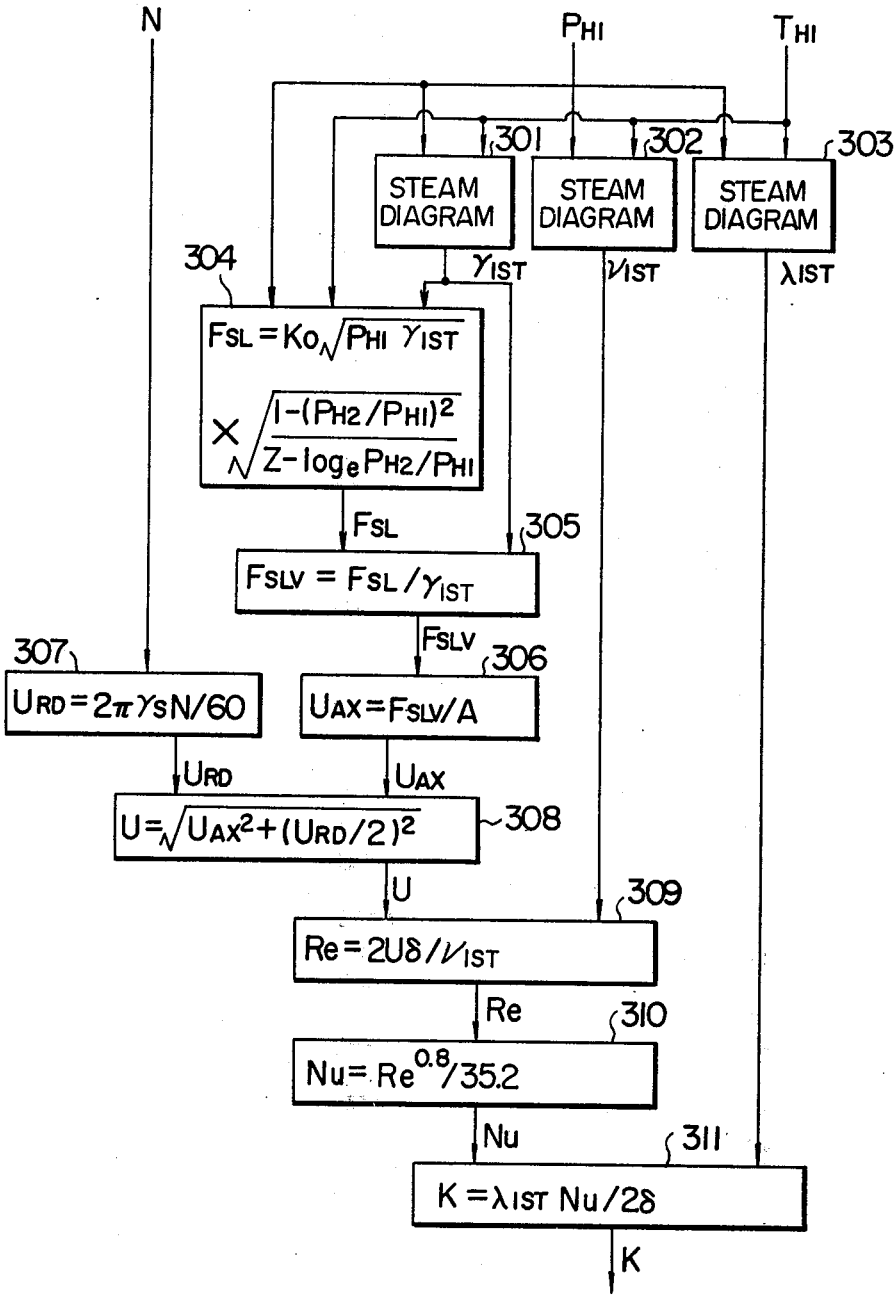
FIG. 11 is an illustration of a procedure for calculating the heat transfer coefficient K at the rotor surface confronting a labyrinth packing.

FIG. 11 shows a block diagram of a system for obtaining the heat transfer coefficient K on the turbine rotor surface from the behind-first stage steam condition as obtained in the above explained procedure and the turbine speed. Since the system as shown in FIG. 11 can be used for both of the high-pressure and intermediate pressure turbines, the explanation will be made exemplarily as to the case of the high-pressure turbine.

The specific weight $\gamma_{1ST}$(kg/m$^3$), kinematic coefficient of viscosity $\nu_{1ST}$(m$^2$/sec) and the heat conductivity $\lambda_{1ST}$(Kcal/m.°C.sec) of behind-first stage steam at the steam condition of $R_{H1}$ and $T_{H1}$ are obtained by the blocks 301, 302 and 303, making use of a memory device in which the data of steam table are stored in the form of, for example, functions. The block 304 calculates the flow rate (Kg/sec) of the steam flowing through the gap between the labyrinth packing and corresponding portion of the rotor. Ko is a constant determined by the form of the turbine, Z represents the number of fins of the labyrinth packing, and $P_{H1}$ and $P_{H2}$ represent, respectively, the steam pressures behind the first and second stages of the high-pressure turbine.

The block 305 calculates the voluem $F_{SLV}$(m$^3$/sec) of steam flowing through the gap between the labyrinth packing and the rotor, making use of the flow rate $F_{SL}$ (Kg/sec) as obtained by the block 304. The block 306 calculates the velocity $U_{AX}$(m/sec) of the axial velocity of the steam passing through the gap between the labyrinth packing and the rotor, from the flow rate $F_{SL}$ as obtained by the block 306. Symbol A denotes the annular area (m$^2$) between the labyrinth packing and the rotor. The block 307 is adapted to calculate the surface velocity $U_{RD}$ (m/sec) of the portion of the rotor confronting the labyrinth packing. Symbols $\pi$ and $r_s$ represents, respectively, the ratio of circumference to diameter of the rotor and the radius (m) of the rotor. The blocks 309 and 310 calculate the Reynolds number Re and the Nusselt's number Nu, respectively. The symbol $\delta$ represents the labyrinth packing clearance (m). Finally, the heat transfer coefficient K (Kcal/m$^2$.°C.sec) of the heat transfer from the steam to the rotor surface around the labyrinth packing behind first stage is calculated by the block 311. The heat transfer coefficient thus obtained is used as the boundary condition for calculating the non-steady internal stress distribution of the rotor.

As has been stated, the processing performed by the rotor surface heat transfer coefficient calculation facility 108 is made in accordance with the turbulent flow heat transfer from the steam passing through the gap between the labyrinth packing and the rotor. The same process as shown in FIG. 11 is applied also to the intermediate-pressure turbine. However, since the high-pressure turbine and the intermediate-pressure turbine usually have different values of $\delta$, Z, A, $r_s$ and $P_{H2}/P_{H1}$. Thus, in adopting the system as shown in FIG. 11 in the calculation for the heat transfer coefficient in the intermediate-pressure turbine, attention must be paid to use the values peculiar to the intermediate-pressure turbine.

In the system as shown in FIG. 11, the pressure ratio ($P_{H2}/P_{H1}$) of the pressure behind second stage to the pressure behind the first stage is treated as a constant, because this ratio can be regarded as being constant irrespective of the change of running condition, e.g. speed, speed increasing rate and load.

Figure 12:
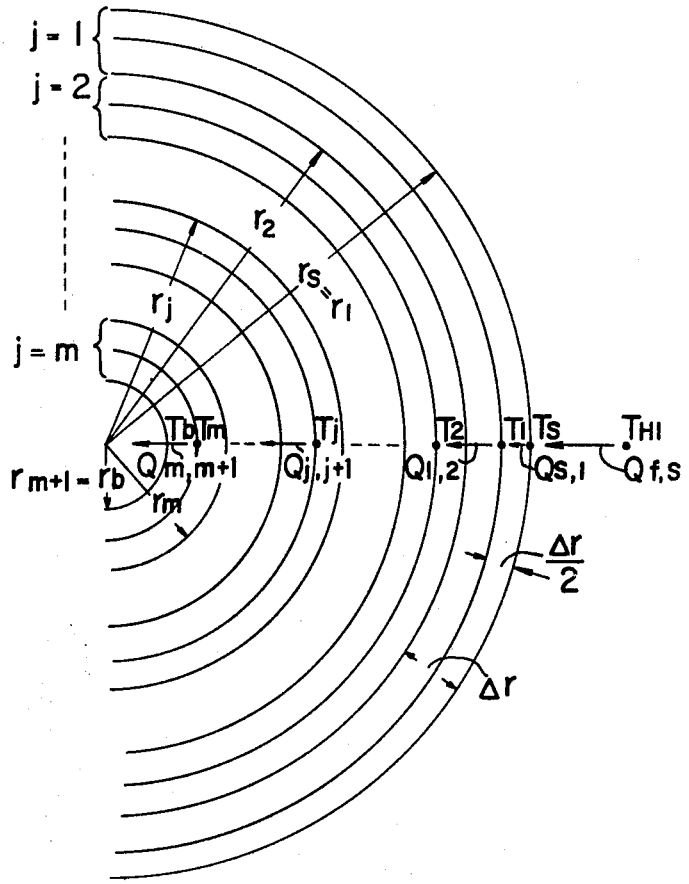
FIG. 12 is an illustration of the concept of the heat balance between the annular sections of an imaginary cylinder.

Hereinafter, the function of the rotor temperature distribution facility 109 will be described with reference to FIG. 12. The movement of heat in the rotor takes place materially only in the radial direction. For this reason, the rotor is devided into m (1, 2, 3 . . . m) imaginary annular sections as shown in FIG. 12. The temperature distribution is calculated by way of heat balances over the annular sections. The period of the heat balance calculation is set at $\tau_1$. In FIG. 12, $Q_{f,s}$ represents the heat delivered from the steam to the rotor surface in the period $\tau_1$. Similarly, $Q_{s,l}$ represents the amount of heat delivered from the rotor surface to the core of the outermost (j=1) annular section. Thus, $Q_{j,j+l}$ represents the amount of heat delivered from the jth annular section to the j+1 th annular section. Since the rotor bore is kept in adiabatic condition, the heat amount $Q_{m,m+l}$ is always 0 (zero).

Representing the present instant by t, the amounts of heat delivered to and from adjacent annular sections, between the period $\tau_1$ from an instant $t-\tau_1$ to the present instant t are given by the following equations.

$$Q_{f,s(t)} = 2\pi r_s k(t)\,(T_{Hl(t)} - T_{s(t)})\tau_1 \tag{11}$$

$$Q_{s,1(t)} = 2\pi(r_2 + \tfrac{3}{4}\Delta r)\lambda_M \frac{T_{s(t)} - T_{1(t-\tau 1)}}{\Delta r/2}\tau_1 \tag{12}$$

$$Q_{1,2(t)} = 2\pi r_2 \lambda_M \frac{T_{1(t-\tau 1)} - T_{2(t-\tau 1)}}{\Delta r}\tau_1 \tag{13}$$

$$Q_{j,j+1(t)} = 2\pi r_{j+1}\lambda_M \frac{T_{j(t-\tau 1)} - T_{j+1(t-\tau 1)}}{\Delta r} \tag{14}$$

$$Q_{m,m+1(t)} = 0 \tag{15}$$

wherein, $\lambda_M$ is the heat conductivity of the rotor material, K(t) is the rotor surface heat transfer coefficient at each instant, Ts is the surface temperature of the rotor, $r_j$ is the outer radius of the j th annular section, $r_1=r_s$ represents the rotor radius, $r_{m+l}=r_b$ is the radius of rotor bore, $\Delta r$ is the thickness of the annular sections, and Tj represents the temperature of J th annular section. The heat transfer coefficient K as explained in relation with FIG. 11 is used for calculating the heat amount $Q_{f,s}$.

Since $Q_{f,s}$ (t) equals to $Q_{s,l}$(t), Ts(t) is given by the following equation (16).

$$T_{s(t)} = \frac{r' T_{1(t-\tau 1)} + 2r_s W(t) T_{H1}(t)}{r' + 2r_s W(t)} \tag{16}$$

where, $$r' = 4r_2 + 3\Delta r$$

and $$W(t) = \Delta r K(t)/\lambda_M$$

The amount of heat $\Delta Qj(t)$ accumulated in j th annular section is given as the difference between the heat input $Q_{j-l,j}$ and the heat output $Q_{j,j+l}$ to and from the same section j, by the following equation (17).

$$\Delta Q_{j(t)} = Q_{j-l,j(t)} - Q_{j,j+l(t)} \tag{17}$$

In this case, the temperature Tj of the jth annular section is given by the following equation (18)

$$T_{j(t)} = T_{j(t-\tau 1)} + \Delta Q_{j(t)}/v_j \rho_M C_M \tag{18}$$

where, vj is the volume of jth annular section per length, $\rho_M$ is the density of the rotor material and $C_M$ is the specific heat of the rotor material.

At the same time, the rotor bore temperature Tb(t) is given by simulating the temperature distribution by a second degree equation as follows.

$$T_{b(t)}=\tfrac{1}{8}(9\cdot T_{m(t)}-T_{m-1(t)}) \tag{19}$$

Figure 13:
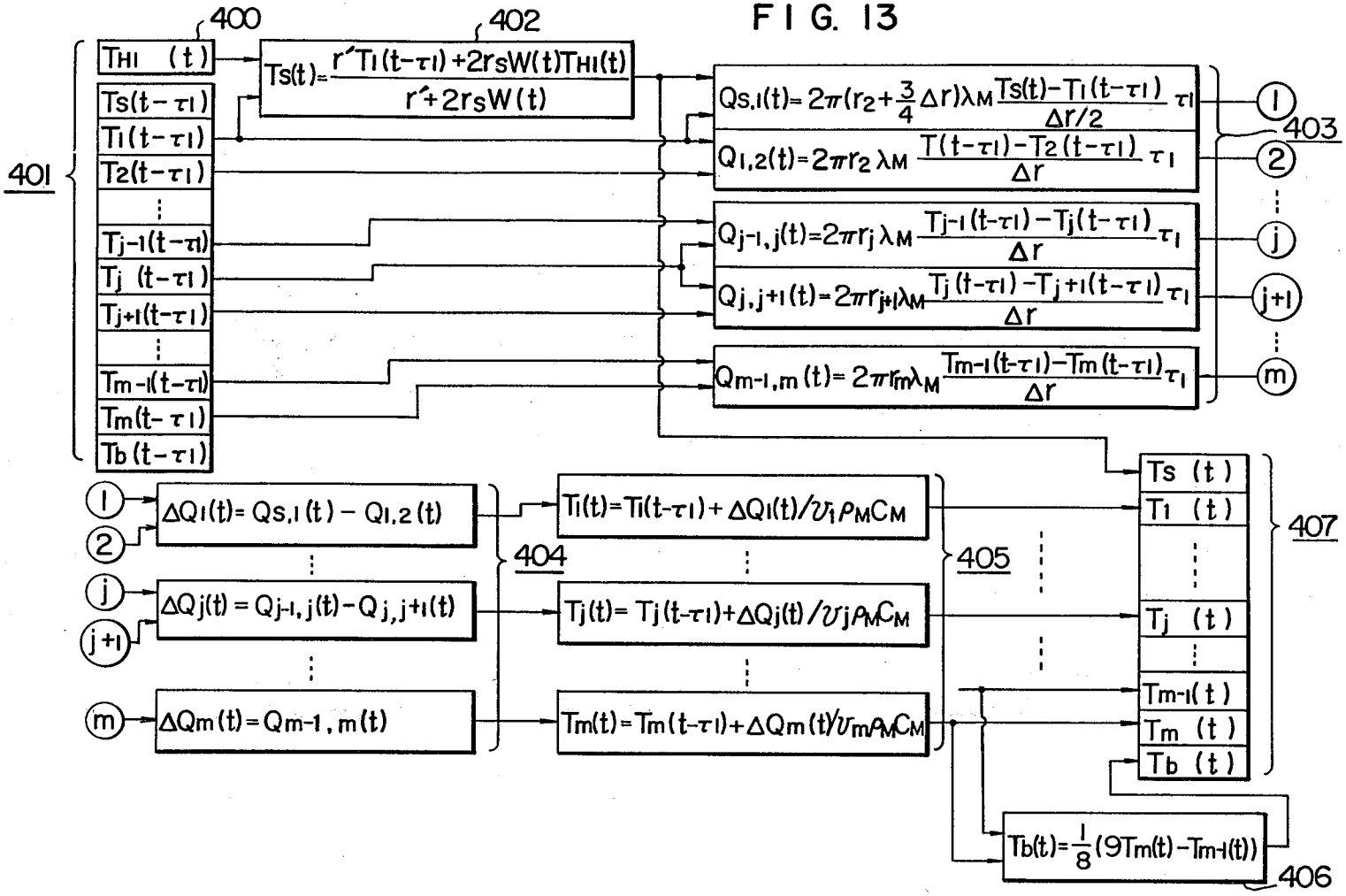
FIG. 13 illustrates a practical procedure of temperature distribution over the rotor.

The above stated process is shown in detail in FIG. 13.

The process as illustrated in this Figure is performed at each operation period which is, in the aforementioned example, one minute.

In the process as illustrated in this Figure, the behind first stage steam temperature $T_{H1(t)}$ at the present operation period, obtained by the process as shown in FIG. 10, and the temperature distribution $Tj(t-\tau_1)$, $Tb(t-\tau_1)$ obtained as a result of the processing in the preceding operation period by the process as shown in FIG. 13. The temperature $T_{H1(t)}$ and the temperatures $Tj(t-\tau_1)$, $Tb(t-\tau_1)$ are memorized in blocks 400 and 401, respectively. The process as shown in FIG. 13 is for calculating the present temperature distribution Ts(t), Tj(t) and Tb(t). These values are output to blocks 406, 407. These values are shifted in the next operation period to the block 401, so as to be used in the next processing.

Referring to FIG. 13, the block 402 is adapted to calculate the present rotor surface temperature $T_s(t)$, making use of the temperatures $T_{H1(t)}$, $T_{1(t-\tau 1)}$, in accordance with the equation (16). Since W(t) is equal to $\Delta rK(t)/\lambda_M$, the heat transfer coefficient K as obtained in the process of FIG. 11 is used for the calculation of the temperature Ts. The block 403 calculates the amount of heat delivery $Q_{j,j+1}$ between adjacent imaginary annular sections, while the block 404 calculates the amount of heat $\Delta Q_{j(t)}$ accumulated in each annular section as a result of the heat delivery. Further, the block 405 calculates the temperature of each imaginary annular section at the present instant, making use of the accumulated heat value ΔQj(t). The present temperature distribution is thus obtained. When the process of FIG. 13 is performed for the first time, there is no rotor temperature distribution data stored in the block 401. In such a case, the initial temperature distribution (See FIG. 4) is used as the rotor temperature distribution of the preceding processing.

Hereinafter, the function of the rotot thermal stress calculation facility 110 will be described.

The thermal stress of the rotor, i.e. the rotor surface thermal stress $\sigma_{ST}$ and rotor bore thermal stress $\sigma_{BT}$ are given by the following equations, on the basis of the temperature distribution calculated by the rotor temperature distribution calculation facility 109.

$$\sigma_{ST}=\frac{E\alpha}{1-\nu}(T_M-T_s) \tag{20}$$

$$\sigma_{BT}=\frac{E\alpha}{1-\nu}(T_M-T_b) \tag{21}$$

where,

E is the Young's modulus of the rotor material, $\alpha$ represents the coefficient of linear expansion of the rotor material, $\nu$ represents the poisson's ratio of the rotor material, $T_s$ represents the surface temperature of the rotor, $T_b$ represents the rotor bore temperature, and $T_M$ represents the mean temperature of the rotor per volume.

The rotor mean temperature per volume $T_M$ is given by the following equation.

$$T_M=\sum_{j=1}^{m} T_j(r_j^2-r_{j+1}^2)/(r_s^2-r_b^2) \tag{22}$$

The stress in the rotor is finally calculated taking also the centrifugal stress into account. Since the centrifugal stress is in proportion to the square of the turbine speed N, the centrifugal stress $\sigma_{BC}$ acting on the rotor bore at a turbine speed N is given by the following equation (23), representing the rated speed and the bore centrifugal stress at the rated speed by No and $\sigma_{BCR}$, respectively.

$$\sigma_{BC}=\sigma_{BCR}\left(\frac{N}{No}\right) \tag{23}$$

Consequently, the bore stress $\sigma_B$ is given as follows.

$$\sigma_B=\sigma_{BT}+\sigma_{BC} \tag{24}$$

There is a concentration of stress in the rotor surface, depending on the form of the rotor surface, so that the thermal stress acts in the axial direction of the rotor, i.e. at a right angle to the centrifugal stress which acts in the circumferential direction. Therefore, the evaluation of the stress in the rotor surface necessitates only the thermal stress which is concerned with the consumption of the turbine life. Thus, the stress $\sigma_s$ in the rotor surface is given by $$\sigma_s=\sigma_{sT} \tag{25}$$

The function of the present stress estimating facility 161 has been described completely.

Hereinafter, a detailed description will be made as to the present stress level checking facility 162. This facility is to judge whether the above explained stresses $\sigma_S$ and $\sigma_B$ are not exceeding the limit stresses $\sigma_{SL}$, $\sigma_B$ as set by the limit stress determining facility 102.

The calculation mode judging facility 163 is the facility adapted to judge whether the present calculation is in the timing for performing the probing of the maximum allowable speed-increase rate on the basis of the preestimating calculation. Thus, when the preestimating calculation is to be made once every n calculations, this facility 19 functions to deliver the result of the stress calculation bypassing the maximum speed-increase probing facility 170 for n−1 calculations out of n.

Hereinafter, the function of the maximum speed-increase probing facility 170 will be described. This facility has a function to preestimate the stresses which will be caused in the rotor surface and rotor bore, at each period of $\tau_1$, from the present instant t over the preestimation time $t_p$ as measured by the preestimation time determining facility 103, and to compare the stress with the limit stress at each time of the preestimation, so as to probe the maximum speed-increase rate which would not cause the future stress exceeding the limit stress $\sigma_L$, throughout the length of the preestimating time $t_p$. The speed-increase rate as mentioned is the rate selected out from the plurality of speed-increase rates $\mathring{N}1$, $\mathring{N}2$ . . . $\mathring{N}x$ . . . $\mathring{N}p$ (rpm/m) as prepared by the speed-increase rate assuming facility 171. The successive speed-increase rates are delivered to the stress preestimating facility 172, one by one, from the largest one to smaller ones. It is assumed here that there is a relationship of: $N1>N2> \ldots >Nx> \ldots >Np$. At first, the stresses in rotor surface and bore at an instant $(t+\tau_1)$, which is $\tau_1$ after the present instant t, are preestimated, by the block 111 of the facility 106. As has been stated in relation with the facility 161, it is necessary to make use of L, $P_{MS}$, N, $\mathring{N}$ and $T_{RH}$ as inputs, for performing the operation of the facility 107. The load L is zero, because, at the present stage of acceleration, no load is imposed on the turbine. The value $\mathring{N}$ is determined by the facility 171. For the preestimation calculation, the $P_{MS}$, $T_{MS}$, N, $T_{RH}$ must be $P_{MS(t+n\tau 1)}$, $T_{MS(t+n\tau 1)}$, $N_{(t+n\tau 1)}$ and $T_{RH(t+n\tau 1)}$, respectively, after the elapse of a time $n\tau_1$. Among these factors, the factor $N(t+n\tau_1)$ can be obtained, making use of the present speed N(t) and speed-increase rate $\mathring{N}$, from the equation of: $N(t+n\tau_1)=N(t)+n\tau_1\cdot\mathring{N}$. The other factors are calculated by the following equations (26), (27) and (28), making use of the results of the steam condition changing rate learning facility 104 as expressed by the foregoing equations (5), (6) and (7), $$P_{MS(t+n\tau 1)} = P_{MS(t)} + \left(\frac{dT_{MS}}{dN}\right)\cdot \mathring{N}\cdot n\tau_1 \quad (26)$$

$$T_{MS(t+n\tau 1)} = T_{MS(t)} + \left(\frac{dT_{MS}}{dN}\right)\cdot \mathring{N}\cdot n\tau_1 \quad (27)$$

$$T_{RH(t+n\tau 1)} = T_{RH(t)} + \left(\frac{dT_{RH}}{dN}\right)\cdot \mathring{N}\cdot n\tau_1 \quad (28)$$

To explain in more detail exemplarily with reference to the equation (26), the $(dP_{MS}/dN)$ represents the change of the pressure $dP_{MS}$ corresponding to the change of the speed dN, as learned by the equation (7). Thus, the $(dP_{MS}/dN).N$ represents the changing rate of the pressure corresponding to the speed-increase rate $\mathring{N}$. Similarly, the $(dP_{MS}/dN)\cdot\mathring{N}\cdot n\tau_1$ represents the change of the pressure caused when the turbine has been accelerated at the rate $\mathring{N}$ for the time length $n\tau_1$. The future pressure $P_{MS(t+n\tau 1)}$ can be obtained by adding this changing amount of pressure to the present pressure $P_{MS(t)}$. At first, the facility 171 assumes $\mathring{N}=\mathring{N}1$ and the facility 106 begins the calculation with n=1, so as to derive $P_{MS}$, $T_{MS}$, N, $T_{RH}$. The thermal stress at the time of n=1 is calculated by blocks 107 to 111. The procedure of calculation performed by the blocks 107 to 111 are identical to that as described before in relation with the facility 161.

The facility 173 compares the thermal stress at the time of $\mathring{N}=\mathring{N}1$ and n=1 with the limit stress $\sigma_L$. If the thermal stress is lower than the limit stress, the facility for judging the elapse of the preestimation time judges whether $n\tau_1 \geqq t_p$ or not. If it is confirmed that $n\tau_1$ is smaller than the preestimation time $t_p$, the calculation is returned to the facility 172. The facility 172 then performs the preestimation of the thermal stress making use of n=2, i.e. the thermal stress expected to take place at the instant $t=2\tau_1$. This operation is repeated until the limit stress comes to be exceeded by a preestimated stress.

Supposing here that the thermal stress preestimated for $\mathring{N}=\mathring{N}1$ and n=3 is judged by the facility 173 to exceed the limit stress, the calculation is returned to facility 171. The facility 171 then assumes the speed-increase rate $\mathring{N}2$ which is next to the largest one $\mathring{N}1$. The facility 106 again sets n=1, and the thermal stress for the speed-increase ratio $\mathring{N}2$ and the instant $t+\tau_1$ is calculated in the same manner as stated before. The facility 170 repeatedly performs the above stated cycle of calculation. When it is confirmed that the limit stress is not exceeded by the preestimated stress until the time $n\tau 1$ becomes equal or longer than $t_p$, for a certain speed-increase rate, e.g. $\mathring{N}x$, the repeated calculation is ceased by the block 174, and the processing is delivered to the critical speed judging facility 164. That is, the speed-increase rate as obtained by the facility 170 is adopted as the maximum allowable speed-increase rate. The speed-increase rate of the turbine is held at 0 (zero), if none of the speed-increase rates can provide the thermal stress which would not exceed the limit stress over the whole preestimation time length.

The above stated function of the facility 170 will be described with reference to FIG. 8. This function is performed in the course of the speed-increase $(t_o-t_1)$. Supposing that $n_T=\tau_2/\tau_1=3$, and that the time length $\tau_1$ is one minute, the operation of the facility 170 is performed once every three minutes. However, as stated before with reference to FIGS. 6, 7, it is necessary to change the preestimation time $t_p$, when the turbine speed N has been increased to the rated speed No, at an instant t1. In such a case, the facility 170 functions as follows. The operation of this facility is performed once every three minutes even in this case. At first, the facility 171 sets the speed-increase rate $\mathring{N}$ at zero (0) (rpm/m) and, insteadly, sets the load L at a level corresponding to that of the initial load. The facility 106 then calculates the values of $T_{MS(t+n\tau 1)}$, $T_{RH(t+n\tau 1)}$, and $P_{MS(t+\tau 1)}$, setting n and N at 1 and No, respectively. The blocks 107 to 111 performs the same functions as those in the foregoing description. The facility 173 compares the preestimated thermal stress $\sigma$ for n=1 with the limit stress $\tau_L$, and delivers the processing to the block 174 when the thermal stress $\sigma$ is smaller than the limit stress $\sigma_L$. At the same time, the processing is delivered back to the block 172 when $n\tau_1$ is not greater than $t_p$. The block 172 repeates the same operation setting the number n at n+1. In the course of this repeated operation, the processing is delivered to the block 164, when the preestimated stress $\sigma$ becomes larger than the stress limit $\sigma_L$ in the block 173. The processing after the rated turbine speed is reached is different from that in the speed-increase mode in the above stated point. Namely, when the limit stress $\sigma_L$ is exceeded by the preestimated stress $\sigma$ before the preestimation time is reached, the function of the facility 170 is restarted at an instant after $n_T$ from the instant at which the preestimated stress comes to exceed the limit stress.

Thus, the facility 174 delivers a circuit breaker closing allowance instruction to the circuit breaker closing facility 14, when it is confirmed that the limit stress $\sigma_L$ will not be exceeded by the future stress $\sigma$ over the preestimation time $t_p$ from the present instant.

The critical speed judging facility 164 is a facility for judging whether the present turbine speed is within the range of the critical speed or not. The result of this judgement has a substantial significance in the subsequent determination of the optimum speed increase rate.

The optimum speed-increase rate determining facility 165 has a function to set the maximum allowable speed-increase rate probed by the maximum speed-increase rate probing facility 170 in the governor 10. However, when it is judged by the facility 164 that the present turbine speed is within the range of the critical speed, this facility 165 does not change the speed-increase rate but, rather, instructs the governor to keep the present speed-increase rate. Further, this facility is adapted to hold the present turbine speed, irrespective of the result of the probing of the maximum allowable speed-increase rate, when it is judged by the facility 163 that the present stress has become greater than the limit stress. However, even in the latter case, the facility 165 instructs to maintain the present speed-increase rate, if the present turbine speed is within the range of the critical speed. Needless to say, the speed-increase rate $\dot{N}$ is set at zero (0), after the instant $t_1$ at which the rated turbine speed is reached.

As will be seen from the foregoing description, the setting of the optimum speed-increase rate in the governor 10 is made once every $n\tau_1$. While the present stress is observed once every period of $\tau_1$. Since the present turbine speed is held when the present stress is found to exceed the limit stress, the turbine can be accelerated in quite a safe manner, even if the steam condition at the turbine inlet is happened to be changed due to a disturbance or the like reason which could not be expected at the time of preestimation calculation.

Then, after the circuit breaker 16 is closed to impose an initial load on the turbine, subsequent to the completion of acceleration, the operation mode is switched from the speed control system 160 to the load control system 140.

Hereinafter, the operation of the control system under the closed state of the circuit breaker, i.e. the functions of facilities belonging to the load control system 140 will be described.

The functions of the present stress estimating facility 141, present stress level checking facility 142, calculation mode judging facility 143 and the maximum load variation changing rate probing facility 150 are materially identical to those of the facilities 161, 162, 163 and 170 of the speed control system 160. The difference between these systems resides only in that the system 160 deals with the speed-increase rate, while the system 140 deals with the load variation rate. For this reason, the detailed description of the functions of above-mentioned facilities is omitted, and the description of the load control system will be focussed to the point of difference.

The load variation rate supposing facility 151 in the maximum load variation rate probing facility 150 is adapted to assume a plurality of previously prepared positive load variation rates, one by one, from the largest one to the smallers, when the load demand $L_R$ demands the increase of the output. To the contrary, when the load demand is demanding the reduction of the output, the facility 151 selects successive negative load variation rates, from the one having the largest absolute value to the ones having smaller absolute values.

Then, the steam condition at an instant $n\tau_1$ after the present instant is calculated by the facility 106. The calculation is made in accordance with the following equations, in contrast to the calculation in the speed control system 160.

$$P_{MS(t+n\tau 1)} = P_{MS(t)} + \left(\frac{dP_{MS}}{dL}\right) \cdot \dot{L} \cdot n\tau_1 \quad (29)$$

$$T_{MS(t+n\tau 1)} = T_{MS(t)} + \left(\frac{dT_{MS}}{dL}\right) \cdot \dot{L} \cdot n\tau_1 \quad (30)$$

$$T_{RH(t+n\tau 1)} = T_{RH(t)} + \left(\frac{dT_{RH}}{dL}\right) \cdot \dot{L} \cdot n\tau_1 \quad (31)$$

In above equations, factors $(dP_{MS}/dL)$, $(dT_{MS}/dL)$ and $(dT_{RH}/dL)$ are the values which have been learned in the steam condition changing rate learning facility 104. $\dot{L}$ denotes the load variation rate as assumed by the facility 151. The values of $T_{MS}$, $P_{MS}$ and $T_{RH}$ at an instant $n\tau_1$ after the present instant are calculated in accordance with the above equations. Then, the behind-first stage steam condition is calculated by the block 107, making use of the above calculated values.

Consequently, the maximum load variation rate is calculated by the facility 150. The facilities in the facility 152 other than 106 and 107, and the functions of the facilities 152, 153 are not detailed here, because they are strictly identical to those in the speed control system.

Referring now to the optimum load variation rate determining facility 144, this facility has two functions. One of these functions is to set in the ALR 7 the maximum load variation rate as probed by the maximum load variation rate probing facility 150, and to correct the same. At the same time, if it is judged that the present stress has come to exceed the limit stress, on the midway of the term $\tau_2$, this instructs the ALR to hold the present load. Thus, the first function is same to the function of that in the speed control system.

The second function is a load limiting function which is to draw an upper limit of load in accordance with the steam condition. This function is provided for protecting the final stage blade of the low-pressure turbine against an errosion which may, for otherwise, take place if a large load is imposed on the turbine when the mainsteam temperature or the reheated steam temperature is low.

Figure 14:
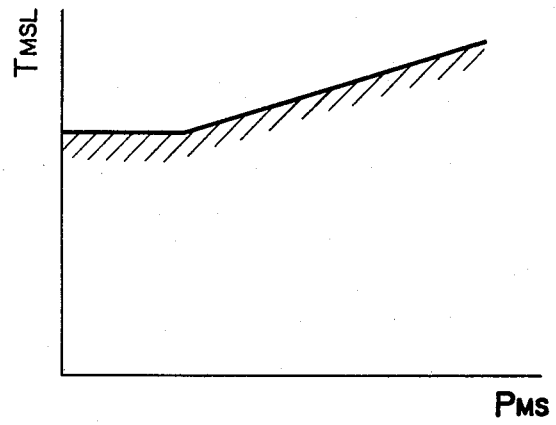
FIG. 14 shows the lower limit of main steam temperature for the purpose of load limitation.
Figure 15:
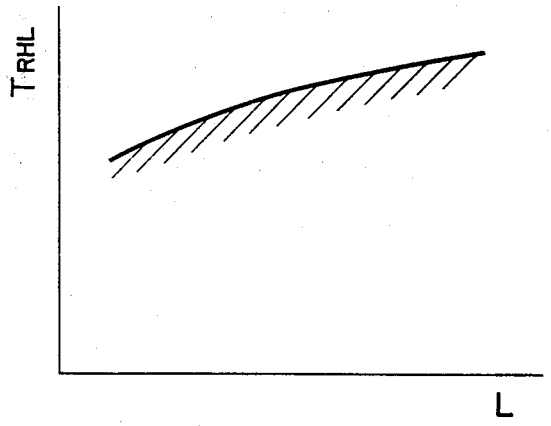
FIG. 15 shows the lower limit of main steam temperature of the reheated steam for the purpose of load limitation.

This second function consists in holding the present load unless both of the lower limits of the main steam temperature and reheated steam temperature, which are determined in accordance with the limit of the wetness in the final stage of the low-pressure turbine, as shown in FIGS. 14 and 15.

More specifically, referring to FIG. 14 showing the load limiting function by the main steam temperature $T_{MS}$, the present load is held if the main steam temperature is not higher than the lower limit $T_{MSL}$ which varies depending on the pressure $P_{MS}$. Similarly, referring to FIG. 15 showing the load limiting function by the reheated steam temperature $T_{RH}$, the present load is held unless the reheated steam temperature is higher than the lower limit $T_{RHL}$ which varies depending on the load level L.

Hereinafter, a description will be made as to the probe signal generating facility 145. This facility adopts a method of preestimating the steam condition changing rate in which the future value is preestimated by the block 106, on the basis of the steam condition changing rate learned by the facility 104 in the manner as described in relation with FIG. 9. However, as will be understood from the equations (8), (9) and (10), a larger steam condition changing rate than normal one is learned and memorized, when the steam condition is abruptly changed due to a disturbance applied to the boiler control, in the course of the learning by the facility 104. In such a case, the stress is preestimated to be much greater than the actual future stress, so that the present level of load is held unchanged, in spite that the actual stress is much smaller than the limit stress. This may result in the failure of smooth load increase.

Figure 16:
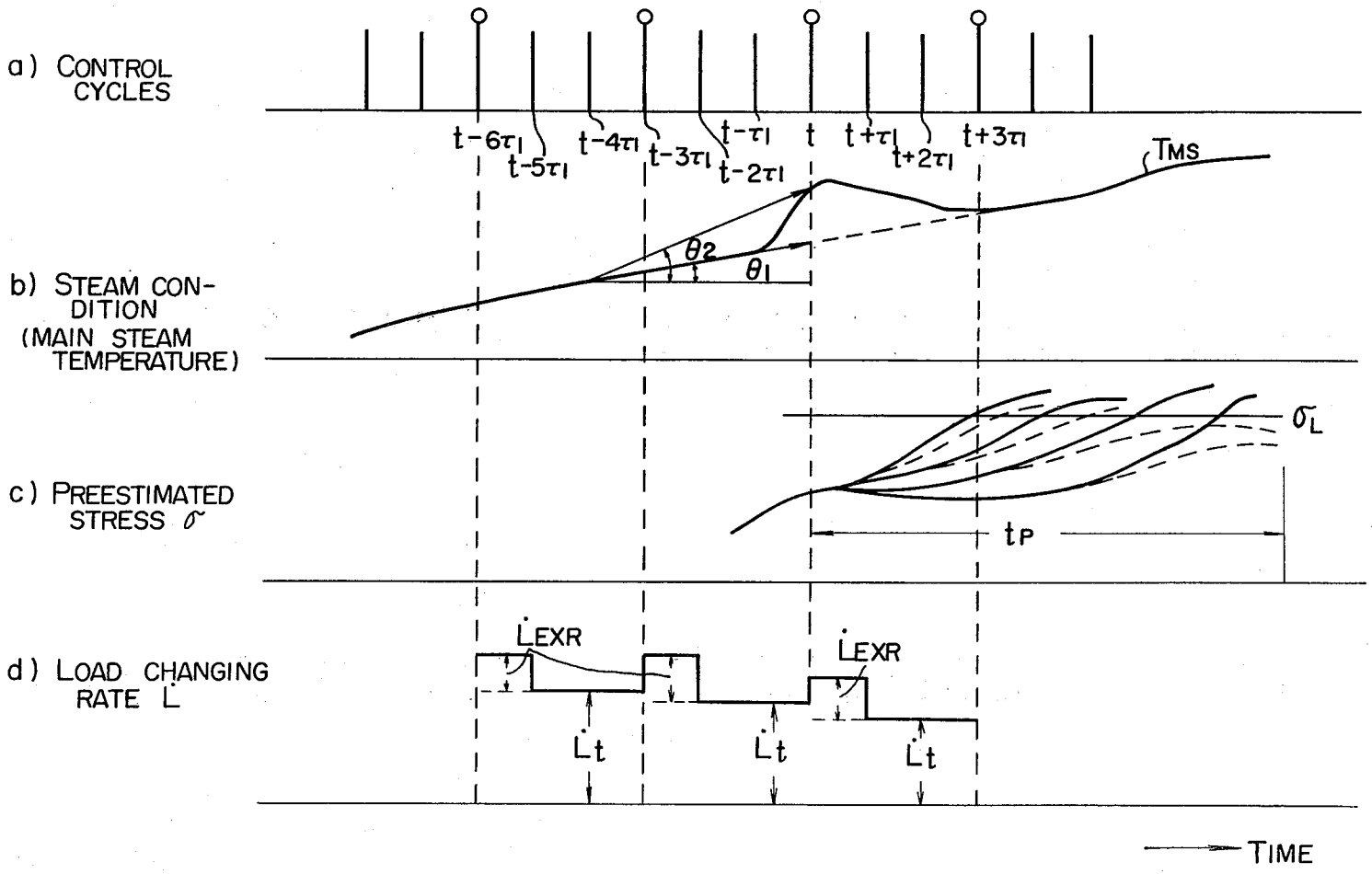
FIG. 16 illustrates a correction of the changing-rate learning function by means of a probe signal.

This situation will be described in more detail with reference to FIG. 16. FIG. 16 (*a*) shows the control cycles of the control system in accordance with the invention. The determination of changing rate is performed once every n (n being 3, for example) control cycles. The timing at which the preestimating control is performed is marked at °. Thus, in the control cycles which are not marked at °, only the observation of the present thermal stress is performed. FIG. 16(*b*) shows the change of the main stream temperature $T_{MS}$ as a factor of the steam condition. It is assumed that the main steam temperature $T_{MS}$ is abruptly increased in the course of the control, as illustrated.

At an instant t, the preestimation of the thermal stress is conducted on the basis of the future steam condition as obtained by the equations (29) to (31). The values ($dT_{MS}/dL$), ($dT_{RH}/dL$) and ($dP_{MS}/dL$) as learned in accordance with the equations (8), (9) and (10) are used in this stress preestimation. However, as will be clear also from FIG. 16(*b*), the changing rate $dT_{MS}=T_{MS(t)}-T_{MS(t-n\tau 1)}$ transiently assumes a large value. Namely, if the number n is set at 4, the gradient, which is inherently $\theta_1$, is learned to be $\theta_2$. Thus, the thermal stress preestimated by means of the steam condition information obtained at a time of abrupt increase of steam condition is inevitably made impractically large. In such a case, as shown in FIG. 16(*c*), none of the speed-increase rates $\mathring{N}$ can provide preestimated stress smaller than the limit stress. Consequently, the turbine has to be operated at an instant $t+3\tau_1$ by an instruction to keep the speed-increase rate at zero (0). This goes quite contrary to the requirement of the startup of the turbine in the minimum allowable time.

The probing signal generating facility 145 is a facility adapted to generate a probe signal $\mathring{L}_{EXR}$, for the purpose of avoiding above stated lagging of the startup. The steam condition changing rate learning facility 104 is corrected by the result of this probing. The description of this correcting function has been intentionally neglected from the description of the function of the facility 104, for an easier understanding of the invention. This correcting function will be more fully understood from the following description.

Referring to FIG. 16(*d*), a symbol $\mathring{L}_t$ denotes the maximum load variation rate as obtained through the preestimation of the future thermal stress. The probe signal $\mathring{L}_{EXR}$ is superposed to the signal $\mathring{L}_t$. However, this is made only for a short period of $\tau_1$ from the instant of preestimation, because the superimpose over a long time would cause a disturbance.

The level of the probe signal is determined as follows.

Among the values obtained by normalizing the present stresses in the rotor surfaces and bores of high-pressure and intermediate-pressure turbines by respective limit stresses, the one having the largest absolute value is defined here as $\sigma_{MN}$.

Thus the value $\sigma_{MN}$ is given by the following equation (32).

$$\sigma_{MN} \equiv \mathrm{Max}\left(\left|\frac{\sigma_{HS}}{\sigma_{LS}}\right|, \left|\frac{\sigma_{IS}}{\sigma_{LS}}\right|, \left|\frac{\sigma_{HB}}{\sigma_{LB}}\right|, \left|\frac{\sigma_{IB}}{\sigma_{LB}}\right|\right) \quad (32)$$

where, $\sigma_{LS}$, $\sigma_{LB}$, $\sigma_{HS}$, $\sigma_{IS}$, $\sigma_{HB}$ and $\sigma_{IB}$ represent, respectively, the limit stress for rotor surface, limit stress for rotor bore, stress in the high-pressure turbine rotor surface, stress in the intermediate-pressure turbine rotor surface, stress in the high-pressure turbine rotor bore and the stress in the intermediate-pressure turbine rotor bore.

Figure 17:
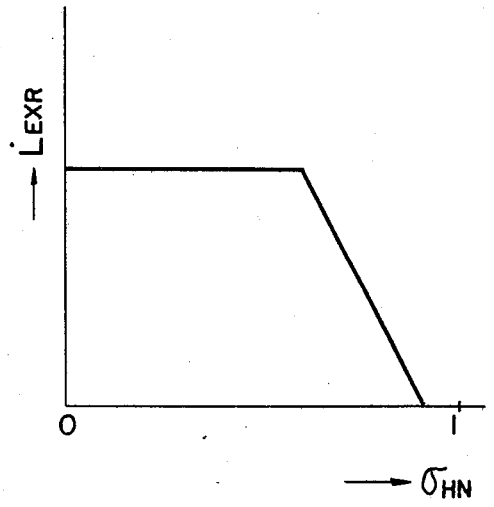
FIG. 17 shows how the changing rate of the probe signal is determined.

The equation (32) is to select the present stress, from the four present stresses, having the smallest margin in relation with the limit stress. The magnitude of the probe signal $\mathring{L}_{EXR}$ is determined in accordance with the value $\sigma_{MN}$, in the manner as shown in FIG. 17. Thus, the smaller the margin of stress becomes (i.e. the closer to 1 the $\sigma_{MN}$ becomes), the smaller the magnitude of the probe signal $\mathring{L}_{EXR}$ is made.

The facility 104 calculates how the values of $T_{MS}$, $P_{MS}$ and $T_{RH}$ are changed as a result of the superpose of the signal $\mathring{L}_{EXR}$, and corrects the equations (8), (9) and (10) in accordance with the result of the calculation. In the course of calculation, the changes of the steam conditions attributable to the probe signal $\mathring{L}_{EXR}$ are given by $dT_{MS}/dL_{EX}$), ($dT_{RH}/dL_{EX}$) and ($dP_{MS}/dL_{EX}$), respectively. The change $dL_{EX}$ of the probe signal equals to the product of $\mathring{L}_{EXR}$ and $\tau_1$, i.e. $\mathring{L}_{EXR} \times \tau_1$. In order to extract only the change caused by the $L_{EXR}$, for example, $dT_{MS}/dL_{EX}$, the following measure is taken. Namely, the change of the steam condition $dT_{MS}$ is obtained as the difference ($dT_{MS}(\tau_1)-dT_{MS}(\tau_2)$) between the changing amount $dT_{MS}(\tau_1)$ of the temperature $T_{MS}$ in a period $\tau_1$ starting from an instant $t-3\tau_1$, and the same $dT_{MS}(\tau_2)$ in the next period $\tau_1$.

The correction is effected in accordance with the following equation.

$$\left(\frac{dT_{MS}}{dL}\right) = \beta\left(\frac{dT_{MS}}{dL_{EX}}\right) + (1-\beta)\left(\frac{dT_{MS}}{dL}\right) \quad (33)$$

In above equation, a symbol $\beta$ denotes a correcting weight factor and is determined by $1 \geqq \beta \geqq 0$. Similar corrections are made for ($dT_{RH}/dL$) and ($dP_{MS}/dL$).

In the above equation (33), the term including the result of learning by the equations (8), (9) and (10) are multiplied by $1-\beta$. Therefore, even if the result of the learning by the equations (8), (9) and (10) includes the component corresponding to the abrupt increase of the steam condition, this component is conveniently be reduced due to the presence of the factor $1-\beta$, so that the thermal stress preestimation at the instant $t+3\tau_1$ can be made without causing the failure of due load increase. Namely, referring to FIG. 16(*c*), the thermal stress as obtained from the corrected $dT_{MS}/dL$ changes following the broken line curves, so that the load variation rate is never made zero. Consequently, the undesirable stall or lagging of the load change over a long period time is fairly avoided.

After the closing of the circuit breaker, while the load on the turbine is still low, the response of the steam condition at the turbine inlet to the increase of the load, particularly the rising characteristic of the reheated steam temperature, is varied largely. More specifically, the time constant for the temperature rise is varied largely.

Figure 18:
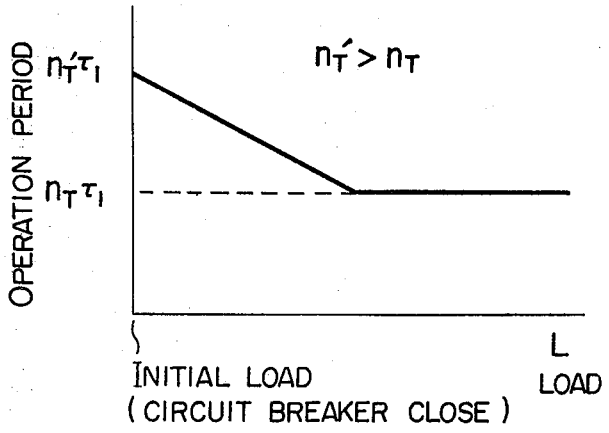
FIG. 18 shows the procedure for determining the operation period of the control system.

In order to make an efficient use of the result of the learning of steam condition changing rate even in such a condition, it is necessary to correct the period of signal setting in the ALR in accordance with the change of the time constant. To this end, the calculation mode judging facility 143 of the load control system 140 is made to have a function as shown in FIG. 18. Namely, the maximum load variation rate probing facility is started after correctly learning the response behaviour of the steam condition having a large time constant, through setting the period of the probing of the maximum load variation rate larger than $n\tau_1$, specifically at the light load range of the turbine operation.

To sum up, the following advantages are offered by the present invention.

(1) The rates of turbine speed increase and load increase are optimized through a preestimation of the future rotor stress based upon the preestimation of the steam condition at the turbine inlet. This allows a safe startup and loaded running of the turbine efficiently and faithfully following the maximum allowable stress, i.e. the limit stress, and contributes to minimize the startup time and to improve the load-following-up characteristic of the turbine.

(2) The load imposed on the controlling computer is reduced considerably, because the kinds and amounts of informations to be treated by on-line is reduced. In addition, since the present stress is taken into consideration, the stress control can be made in a stable manner, and, accordingly, the turbine can be controlled with an improved reliability.

What is claimed is:

1. A rotor-stress preestimating turbine control system adapted for use in a power generating plant having a source of a working fluid, a valve for regulating the flow rate of the working fluid generated by said source, a turbine adapted to be driven by said working fluid and an alternator mechanically connected to said turbine, said control system being adapted to calculate the stress caused in said turbine due to a change of the condition of said working fluid and to control the operation of said turbine in accordance with the calculated stress, said control system being characterized by comprising: a first means for setting a plurality of changing rates of the running condition of said turbine; a second means adapted to preestimate the stress expected in the turbine rotor over a predetermined preestimation time on the assumption that said turbine is operated at said changing rates; and a third means adapted to select the maximum changing rate which would not cause the preestimated stress to exceed a limit stress; whereby said turbine is controlled in accordance with the output from said third means.

2. A rotor-stress preestimating turbine control system as claimed in claim 1, characterized by further comprising a fourth means adapted to calculate and observe the stress in said turbine rotor at each control cycle, wherein the functions of said first, second and third means are performed once every $n_T$ control cycles.

3. A rotor-stress preestimating turbine control system as claimed in claim 1, wherein said plurality of changing rates are a plurality of speed changing rates in the no-load running mode of said turbine, wherein said second means is adapted to preestimate the future stress for the successive speed changing rates, from the largest one to the smaller ones, while said third means is adapted to output the speed changing rate which has been confirmed for the first time not to cause any future stress exceeding said limit stress.

4. A rotor-stress preestimating turbine control system as claimed in claim 2, wherein said plurality of changing rates are a plurality of speed changing rates in the no-load running mode of said turbine, wherein said second means is adapted to preestimate the future stress for the successive speed changing rates, from the largest one to the smaller ones, while said third means is adapted to output the speed changing rate which has been confirmed for the first time not to cause any future stress exceeding said limit stress.

5. A rotor-stress preestimating turbine control system as claimed in claim 1, wherein said plurality of changing rates are a plurality of positive and negative load variation rates in the loaded running condition of said turbine, wherein said second means is adapted to perform the preestimation of the future stress for the successive positive load variation rates, from the largest one to smaller ones, when the level of load demand imposed on said power station is higher than that of the present load, and for the successive negative load variation rates, from one having the largest absolute value to the ones having smaller absolute values, when said level of load demand is lower than that of the present load, while said third means is adapted to output the load variation rate which has been confirmed for the first time not to cause any future stress exceeding said limit stress.

6. A rotor-stress preestimating turbine control system as claimed in claim 2, wherein said plurality of changing rates are a plurality of positive and negative load variation rates in the loaded running condition of said turbine, wherein said second means is adapted to perform the preestimation of the future stress for the successive positive load variation rates, from the largest one to smaller ones, when the level of load demand imposed on said power station is higher than that of the present load, and for the successive negative load variation rates, from one having the largest absolute value to the ones having smaller absolute values, when said level of load demand is lower than that of the present load, while said third means is adapted to output the load variation rate which has been confirmed for the first time not to cause any future stress exceeding said limit stress.

7. A rotor-stress preestimating turbine control system adapted for use in a power generating plant having a source of a working fluid, a valve for regulating the flow rate of the working fluid generated by said source, a turbine adapted to be driven by said working fluid and an alternator mechanically connected to said turbine, said control system being adapted to calculate the stress caused in said turbine due to a change of the condition of said working fluid and to control the operation of said turbine taking into account the calculated stress, said control system being characterized by comprising a first control portion including: a first means for setting a plurality of changing rates of the running condition of said turbine; a second means adapted to preestimate the stress expected in the turbine rotor over a predetermined preestimation time on the assumption that said turbine is operated at said changing rates; and a third means adapted to select the maximum changing rate which would not cause the preestimated stress to exceed a limit stress, said first control portion being adapted to perform the operation once every $n_T$ control cycles; said control device further comprising a second control portion adapted to calculate the present stress in said turbine rotor and to observe the same at each control cycle, and being adapted to control said turbine by means of the output derived from said third means;

wherein, in said first control portion, said changing rates of the running condition are a plurality of speed changing rates, in case of no-load running of said turbine, said second means is adapted to preestimate the future stress for the successive speed changing rates, from the largest one to smaller ones, while said third means is adapted to output the speed changing rate which has been confirmed for the first time to provide future stress not exceeding said limit stress; whereas said changing rates of the running condition are a plurality of positive and negative load variation rates, in case of the loaded running of said turbine, said second means is adapted to perform the preestimation of the future stress for the successive positive load variation rates, from the largest one to the smaller ones, when the level of load demands imposed on said power plant is higher than that of the present load, and for the successive negative load variation rates, from one having the largest absolute value to the ones having smaller absolute values, when said level of said load demand is lower than that of said present load, while said third means is adapted to output the load variation rate which has been confirmed for the first time not to cause a future stress exceeding said limit stress.

8. A rotor-stress preestimating, turbine control system adapted for use in a power generating plant having a source of a working fluid, a valve for regulating the flow rate of the working fluid generated by said source, a turbine adapted to be driven by said working fluid and an alternator mechanically connected to said turbine, said control system being adapted to calculate the stress caused in said turbine due to a change of the condition of said working fluid and to control the operation of said turbine taking into account the calculated stress, said control system being characterized by comprising: a first control portion including a first means for setting a plurality of changing rates in accordance with the running condition of said turbine; second means adapted to preestimate the stress expected in the turbine rotor over a predetermined preestimation time on the assumption that said turbine is operated at said changing rates; and a third means adapted to select the maximum changing rate which would not cause the preestimated stress to exceed a limit stress, said first control portion being adapted to perform operation once $n_T$ control cycles; said control system further comprising a second control portion adapted to calculate the present stress in said turbine rotor and to observe the same at each control cycle; said control system being adapted to control said turbine by means of the output derived from said third means;

characterized in that said changing rate, which is the output from said third means, is reduced substantially to zero, when it is judged by said second control portion that the present stress is greater than the limit stress.

9. A rotor-stress preestimating turbine control system as claimed in claim 8, wherein said changing rates of running condition of turbine are the speed changing rates, in case of no-load running of said turbine.

10. A rotor-stress preestimating turbine control system as claimed in claim 8, wherein said changing rates of running condition of turbine are the load variation rates, in case of loaded running of said turbine.

11. A rotor-stress preestimating turbine control system as claimed in claim 9, wherein the present speed changing rate is maintained irrespective of the present stress calculated by said second controlling portion, when the turbine speed at the present control cycle is within the range of the critical speed of said turbine.

12. A rotor-stress preestimating turbine control system as claimed in claim 10, characterized in that said load variation rate, which is the output derived from said third means, is reduced substantially to zero, when the temperature of said working fluid comes down below the lower limit temperature of said working fluid which is determined by the wetness of the blades of the final stage of said turbine.

13. A rotor-stress preestimating turbine control system adapted for use in a power generating plant having a source of a working fluid, a valve for regulating the flow rate of said working fluid generated by said source, a turbine adapted to be driven by said working fluid, an alternator mechanically connected to said turbine and a circuit breaker electrically connected between said alternator and the external power line, said control system being adapted to calculate the stress caused in said turbine due to a change of condition of said working fluid and to control the operation of said turbine in accordance with the calculated stress, characterized by comprising: a fifth means adapted to deliver a signal corresponding to the initial load which would be imposed on said turbine by closing of said circuit breaker at an instant when the turbine speed is increased substantially to the rated speed; a sixth means adapted to preestimate the future thermal stress expected to be caused in the turbine rotor by an application of said signal corresponding to said initial load by said fifth means, over a predetermined preestimation time, a seventh means adapted to judge whether the future stress preestimated by said sixth means exceeds a predetermined limit stress; and an eighth means adapted to deliver a circuit breaker closing allowance instruction when it is judged by said seventh means that said limit stress is not exceeded by said preestimated future stress; said circuit breaker being adapted to be closed only when a plurality of requisties including the availability of said circuit breaker closing allowance instruction are simultaneously achieved.

14. A rotor-stress preestimating turbine control system as claimed in claim 13, wherein said turbine consists of a high-pressure turbine adapted to be driven by a main steam and an intermediate-pressure turbine adapted to be driven by a reheated steam, and wherein the rate of heating energy supply to said source for turbine-driving working fluid is increased at the time of closing of said circuit breaker, characterized in that said preestimation time over which the stress preestimation is performed by said sixth means is variable in accordance with the difference between the temperature of said main steam and the temperature of said reheated steam.

15. A rotor-stress preestimating turbine control system adapted for use in a power generating plant having a source of a working fluid, a valve for regulating the flow rate of the working fluid generated by said source, a turbine adapted to be driven by said working fluid, an alternator mechanically connected to said turbine and a circuit breaker electrically connected between said alternator and external power line, said control system being adapted to calculate the stress caused in said turbine due to a change of the condition of said working fluid and to control the operation of said turbine taking into account the calculated stress, said control system being characterized by comprising: a first control portion including a first means for setting a plurality of changing rates in accordance with the running condition of said turbine, second means adapted to preestimate the stress expected in the turbine rotor over a predetermined preestimation time on the assumption that said turbine is operated at said changing rates, and a third means adapted to select the maximum changing rate which would not cause the preestimated stress to exceed a limit stress, said first control portion being adapted to perform the operation at a predetermined control period; and a third control portion including a fifth means adapted to deliver a signal, when the turbine speed is increased substantially to the rated speed, corresponding to the initial load which would be imposed on the turbine by a closing of said circuit breaker, a sixth means adapted to preestimate the future thermal stress expected to be caused in the turbine by said initial load, upon receipt of said signal derived from said fifth means, over a second preestimation time, a seventh means adapted to judge whether the stress preestimated by said sixth means exceeds a predetermined limit stress, and an eighth means adapted to deliver a circuit breaker closing allowance instruction when it is judged by said seventh means that said limit stress is not exceeded by the preestimated stress; said circuit breaker being adapted to be closed only when a plurality of requirements including the availability of said circuit breaker closing allowance instruction are satisfied simultaneously; wherein the arrangement is such that said turbine is controlled by said first control portion after the closing of said circuit breaker and that the preestimation time is varied between said second preestimation time and a first preestimation time, over a predetermined period of time starting from the instant at which the turbine control is switched to said first control portion.

16. A rotor-stress preestimating turbine control system as claimed in claim 15, wherein said turbine includes a first turbine making use of a main steam as the working fluid and a second turbine making use of a reheated steam as the working fluid, and wherein the rate of heating energy supply to said source of said working fluid is increased at the time of closing of said circuit breaker, characterized in that the preestimating time over which the stress preestimation by said sixth means is performed is varied in accordance with the difference of temperatures of said main steam and said reheated steam.

17. A rotor-stress preestimating turbine control system adapted for use in a power generating plant having a source for generating a working fluid, a regulating valve adapted to regulate the flow of said working fluid, a turbine adapted to be driven by said working fluid and an alternator mechanically connected to said turbine, said control system being adapted to calculate the stress expected to be caused in said turbine due to a change of condition of said working fluid and to control the operation of said turbine taking into account the calculated stress, characterized in that the behind-first stage fluid pressure $P_{H1}$ in the turbine, which is necessary in estimating the stress caused in the turbine rotor, is calculated by a process having the following steps of: correcting a load L, which is regarded as being proportional to the behind-first stage fluid pressure of the turbine, by a ratio of present turbine inlet fluid pressure $P_{MS}$ and temperature $T_{MS}$ to those $P_{MS}$, $T_{MS}$ of the rated condition, so as to obtain a corrected load L', obtaining the behind-first stage temperature $T'_1$ of the fluid as a function of the corrected load L'; obtaining a fluid temperature drop ΔTo across said valve when the latter is slightly opened; obtaining the throttling factor K1 of said valve determined by said corrected load L'; obtaining a temperature dropping factor K2 across the first stage as the function of turbine speed N; obtaining a behind-first stage fluid pressure $P_{10}$ corresponding to no load as a function of the turbine speed increasing rate $\dot{N}$, turbine speed N and the temperature $T_{MS}$, obtaining the behind-first stage fluid temperature $T_{H1}$ as a function of $T_1'$, K1, K2, $T_{MS}$ and ΔTo, and obtaining the behind-first stage fluid pressure $P_{H1}$ as a function of L and $P_{10}$.

18. A rotor-stress estimating turbine control system adapted for use in a power generating plant having a source for generating a working fluid, a regulating valve adapted to regulate the flow rate of said working fluid, a turbine adapted to be driven by said working fluid and an alternator mechanically connected to said turbine, said control system being adapted to calculate the stress expected to be caused in said turbine due to the change of condition of said working fluid and to control the operation of said turbine taking into account the calculated stress, characterized in that the heat transfer coefficient K of the rotor surface at a portion of the rotor confronting a labyrinth packing, said heat transfer coefficient K being one of the essential factor for estimating the thermal stress caused in said turbine rotor, is obtained by a process having the following steps of: obtaining the specific weight $\gamma_{1ST}$, kinematic coefficient of viscosity $\nu_{1ST}$ and heat conductivity $\lambda_{1ST}$ of said fluid from the temperature and pressure of said fluid at a portion behind the first stage of said turbine, obtaining the flow rate $F_{SLV}$ of said fluid leaking through the gap between said portion of rotor and said labyrinth packing as the function of pressure, temperature and specific weight $\gamma_{1ST}$ of said fluid at behind said first stage of said turbine, obtaining the flow velocity U of said fluid leaking through the gap between said portion of said rotor and said labyrinth packing as a function of said flow rate $F_{SLV}$ and the turbine speed N, and obtaining said heat transfer coefficient K as a function of said flow viscosity U, said kinematic coefficient to viscosity $\nu_{1ST}$ and said heat conductivity $\lambda_{1ST}$.

19. A rotor-stress preestimating turbine control system adapted for use in a power generating plant having a source for generating a working fluid, a valve for regulating the flow rate of said working fluid, a turbine adapted to be driven by said working fluid and an alternator mechanically connected to said turbine, said system being adapted to calculate the stress which is expected to be caused in said turbine due to a change in condition of said working fluid and to control said turbine taking the calculated stress into account, said control system comprising a first control portion including a first portion adapted to set a changing rate of running condition of said turbine, a second means adapted to preestimate the stress over a period of time $n\tau_1$ (n=1, 2, 3 . . . n) from the present instant on the assumption that the turbine is operated at the changing rate as set by said first means, and a third means adapted select the maximum changing rate which would not cause a preestimated stress to exceed a stress limit over said period of time $n\tau_1$, the output derived from said third means being used for controlling the operation of said turbine, characterized in that the steam condition at the turbine inlet at the instant $n\tau_1$ after the present instant, which is essential for the preestimation of the stress by said second means, is calculates as the product of the ratio of the actually measured changing rate of steam condition at the turbine inlet to the actually measured changing rate of running condition of said turbine, said ratio has been obtained as an experience in the past turbine operation, said period of time $n\tau_1$, and said changing rate of turbine running condition as set by said first means.

20. A rotor-stress preestimating turbine control system as claimed in claim 19, wherein said first control portion is adapted to perform its operation at a predetermined control period of repetition, and wherein said ratio of actually measured changing rate of steam condition at the turbine inlet to the actually measured changing rate of the turbine running condition is obtained, when said actually measured changing rate of turbine running condition in the past turbine operation is substantially 0 (zero), by suitably correcting by reducing the ratio as used in the preceding control cycle.

21. A rotor-stress preestimating turbine control system as claimed in claim 19, wherein said steam condition at turbine inlet is the steam temperature and steam pressure at the turbine inlet, while said changing rate of turbine running condition is, in case of no-lead running of said turbine, the speed changing rate of said turbine.

22. A rotor-stress preestimating turbine control system as claimed in claim 20, wherein said steam condition at turbine inlet is the steam temperature and steam pressure at the turbine inlet, while said changing rate of turbine running condition is, in case of no-load running of said turbine, the speed changing rate of said turbine.

23. A rotor-stress preestimating turbine control system as claimed in claim 19, wherein said steam condition at turbine inlet is the steam temperature and pressure at the turbine inlet, and wherein said changing rate of turbine running condition is, in case of loaded running of said turbine, the load variation rate of said turbine.

24. A rotor-stress preestimating turbine control system as claimed in claim 20, wherein said steam condition at turbine inlet is the steam pressure and temperature at the turbine inlet, and wherein said changing rate of said turbine running condition is, in case of loaded running of said turbine, the turbine, the load variation rate of said turbine.

25. A rotor-stress preestimating turbine control system as claimed in claim 23, characterized in that said turbine is controlled at a load variation rate obtained by superposing a correcting load variation rate to said load variation rate obtained as an output from said third means, wherein said ratio of actually measured changing rate of turbine inlet steam condition to the actually measured load variation rate experienced in the past turbine operation is corrected by making use of the ratio of the actually measured changing rate of the steam condition at the turbine inlet to said correcting load variation rate.

26. A rotor-stress preestimating turbine control system as claimed in claim 24, characterized in that said turbine is controlled at a load variation rate obtained by superposing a correcting load variation rate to said load variation rate obtained as an output from said third means, and that said ratio of said actually measured changing rate of steam condition at the turbine inlet to the actually measured load changing rate experienced in the past turbine operation and after the correction by reduction is further corrected by maing use of the ratio of the actually measured changing rate of steam condition at the turbine inlet to said correcting load variation rate.

27. A rotor-stress preestimating turbine control system as claimed in claim 25, wherein said correcting load variation rate is determined in accordance with the ratio of the stress in the present contorl cycle to the limit stress, such that said correcting load variation rate assumes a larger value as said ratio becomes closer to "1".

28. A rotor-stress preestimating turbine control system as claimed in claim 26, wherein said correcting load variation rate is determined in accordance with the ratio of the stress in the present control cycle to the limit stress, such that said correcting load variation rate assumes a larger value as said ratio becomes closer to "1".

29. A rotor-stress preestimating turbine control system adapted for use in a power generating plant having a source for generating a working fluid, a valve adapted to regulate the flow rate of said working fluid, a turbine adapted to be driven by said working fluid, an alternator mechanically connected to said turbine and a circuit breaker electrically connected between said alternator and the external power line, said control system being adapted to calculate the stress caused in said turbine due to a change in the condition of said working fluid and to control the operation of said turbine taking into account the calculated stress, said control system comprising a first control portion including a first means adapted to set a plurality of load variation rates of said turbine, secone means adapted to preestimate the thermal stress which would be caused in said turbine rotor over a predetermined preestimation time, on the assumption that said turbine is operated at said load variation rates and a third means adapted to select the maximum load changing rate which would not cause the preestimated stress over said preestimation time to exceed a limit stress, the output from said third means being used for controlling said turbine, wherein the control period of said first control portion is gradually reduced until the level of the load imposed on the turbine is increased up to a predetermined level, after closing said circuit breaker, and is held constant after the predetermined level of load is reached.

* * * * *